US011826289B2

(12) United States Patent
Lane, II et al.

(10) Patent No.: US 11,826,289 B2
(45) Date of Patent: Nov. 28, 2023

(54) SURGICAL BOOT WITH SPLINED SUPPORT ROD

(71) Applicant: Allen Medical Systems, Inc., Batesville, IN (US)

(72) Inventors: Timothy A Lane, II, Shrewsbury, MA (US); Patrice A Weststrate, Newton Upper Falls, MA (US); David J. Hitchcock, Westford, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 610 days.

(21) Appl. No.: 17/092,492

(22) Filed: Nov. 9, 2020

(65) Prior Publication Data

US 2021/0052455 A1 Feb. 25, 2021

Related U.S. Application Data

(63) Continuation of application No. 15/473,784, filed on Mar. 30, 2017, now Pat. No. 10,835,440.

(60) Provisional application No. 62/316,626, filed on Apr. 1, 2016.

(51) Int. Cl.
*A61G 13/12* (2006.01)
*A61G 13/00* (2006.01)

(52) U.S. Cl.
CPC ..... *A61G 13/1295* (2013.01); *A61G 13/0036* (2013.01); *A61G 13/12* (2013.01); *A61G 13/125* (2013.01); *A61G 13/1235* (2013.01); *A61G 13/1245* (2013.01)

(58) Field of Classification Search
CPC ..... A61G 13/0036; A61G 13/12; A61G 13/1235; A61G 13/1245; A61G 13/125; A61G 13/1295; A61G 13/00
See application file for complete search history.

(56) References Cited

U.S. PATENT DOCUMENTS

| | | | | |
|---|---|---|---|---|
| 1,516,795 | A | 11/1924 | Schwarting | |
| 4,426,071 | A | 1/1984 | Klevstad | |
| 4,431,329 | A | 2/1984 | Baitelle | |
| 4,443,005 | A * | 4/1984 | Sugarman | A61G 13/12 5/651 |
| 4,579,324 | A | 4/1986 | McConnell | |
| 4,615,516 | A * | 10/1986 | Stulberg | A61G 13/12 5/651 |
| 4,702,465 | A | 10/1987 | McConnell | |
| 4,858,903 | A | 8/1989 | Tari et al. | |
| 5,056,535 | A * | 10/1991 | Bonnell | A61G 13/12 606/241 |

(Continued)

FOREIGN PATENT DOCUMENTS

| | | | |
|---|---|---|---|
| EP | 2589364 | A1 | 5/2013 |
| EP | 3017801 | A1 | 5/2016 |
| WO | 9844890 | A1 | 10/1998 |

*Primary Examiner* — Justin C Mikowski
*Assistant Examiner* — Ifeolu A Adeboyejo
(74) *Attorney, Agent, or Firm* — Barnes & Thornburg LLP

(57) ABSTRACT

A limb support comprises a spar, a limb rest, and a coupler. The spar is configured to be supported from a patient support apparatus and adjustable relative to the patient support and has a longitudinal axis. The coupler includes a release that is selectively actuable to release locking mechanisms to permit adjustment of the limb support relative to the spar.

22 Claims, 17 Drawing Sheets

(56) References Cited

U.S. PATENT DOCUMENTS 5,369,827 A * 12/1994 Parke ..... A61G 13/12 5/651
5,582,379 A 12/1996 Keselman et al.
5,775,334 A 7/1998 Lamb et al.
5,802,641 A * 9/1998 Van Steenburg ..... A61G 13/12 5/624
5,806,117 A * 9/1998 Gotfried ..... A61G 13/0081 5/624
5,918,330 A 7/1999 Navarro et al.
5,961,085 A 10/1999 Navarro et al.
5,961,512 A 10/1999 Purnell
6,629,944 B2 10/2003 Smart
6,708,935 B2 3/2004 Smeed
6,874,184 B2 4/2005 Chandler
6,948,501 B2 9/2005 Rastegar et al.
7,131,955 B2 11/2006 Price et al.
7,243,654 B2 * 7/2007 Schuerch ..... A61G 13/12 128/845
7,337,483 B2 3/2008 Boucher et al.
7,422,016 B2 9/2008 Klemm
7,610,917 B2 11/2009 Klemm
7,624,737 B2 12/2009 Klemm
7,657,953 B2 2/2010 Reckelhoff et al.
7,686,267 B2 3/2010 DaSilva
7,771,378 B2 8/2010 Price et al.
7,832,035 B2 11/2010 Walczyk
8,028,702 B2 10/2011 DaSilva
8,256,047 B2 9/2012 Klemm et al.
8,286,283 B2 10/2012 Copeland et al.
8,322,342 B2 12/2012 Soto et al.
8,448,274 B2 5/2013 Broens
8,656,536 B1 2/2014 Sorg
8,845,568 B2 9/2014 Clark et al.
8,856,988 B2 10/2014 Frazier
9,107,792 B2 8/2015 Catacchio et al.
9,173,649 B2 11/2015 Clark et al.
9,271,862 B2 3/2016 Hunter, Jr.
9,381,130 B2 7/2016 Keith-Lucas et al.
2001/0039680 A1 11/2001 Boucher et al.
2002/0179782 A1 12/2002 Smeed
2003/0034037 A1 2/2003 Klemm
2003/0183236 A1 10/2003 Klemm
2003/0200971 A1 10/2003 Rastegar et al.
2004/0226567 A1 11/2004 Klemm
2004/0255384 A1 12/2004 Chandler
2005/0160533 A1 7/2005 Boucher et al.
2005/0240136 A1 10/2005 Price et al.
2007/0265635 A1 * 11/2007 Torrie ..... A61G 13/0081 606/105
2007/0289599 A1 12/2007 Klemm et al.
2008/0034502 A1 2/2008 Copeland et al.
2008/0054698 A1 3/2008 Klemm et al.
2008/0172791 A1 7/2008 Walczyk
2008/0201850 A1 8/2008 Brito et al.
2008/0203644 A1 8/2008 DaSilva
2009/0249551 A1 10/2009 Klemm et al.
2009/0293884 A1 12/2009 DaSilva
2009/0306553 A1 12/2009 Mulholland et al.
2010/0018537 A1 1/2010 Soto et al.
2010/0192302 A1 8/2010 Di Lauro et al.
2010/0293719 A1 11/2010 Klemm et al.
2011/0185506 A1 8/2011 Broens
2012/0031400 A1 2/2012 Shimm
2012/0084925 A1 4/2012 Frazier
2013/0098376 A1 4/2013 Hunter, Jr.
2015/0238380 A1 * 8/2015 Kreuzer ..... A61G 13/1295 5/648
2016/0120726 A1 * 5/2016 Moriarty ..... A61G 13/125 5/649
2016/0151224 A1 * 6/2016 Ferro ..... A61G 13/1295 128/845
2019/0358110 A1 * 11/2019 Schuerch, Jr. ..... A61G 13/1245

* cited by examiner

SURGICAL BOOT WITH SPLINED SUPPORT ROD

CROSS-REFERENCE TO RELATED APPLICATIONS

This application is a continuation of U.S. patent application Ser. No. 15/473,784, filed Mar. 30, 2017, and to U.S. Provisional Application Ser. No. 62/316,626, filed Apr. 1, 2016, each of which are expressly incorporated by reference herein.

BACKGROUND

The present disclosure is related to a support apparatus for supporting a patient. More particularly, the present disclosure relates to a support apparatus including a surgical table and a limb support coupled to the surgical table.

Often, when a patient is sedated for a surgery, the patient is supported by and secured to braces or supports coupled to a surgical table. Sometimes, unique supports are provided for a patient's extremities such as arm boards, leg supports, hand boards, stirrups, and boots.

Supports known in the art sometimes secure patients to resist patient movement. Such supports can sometimes allow excessive patient movement relative to the supports. The position and orientation of supports is often adjusted during surgery to improve access to a surgical site or to move portions of the patient's body such as bones, muscles, tendons, and ligaments to evaluate the surgical results.

SUMMARY

The present application discloses one or more of the features recited in the appended claims and/or the following features which, alone or in any combination, may comprise patentable subject matter:

According to a first aspect of the present disclosure, a limb support comprises a spar, a limb rest, and a coupler. The spar is configured to be supported from a patient support apparatus and adjustable relative to the patient support apparatus, the spar having a longitudinal axis. The coupler is interposed between the limb rest and the spar, the coupler includes a release that is selectively actuable to (i) release the limb rest to rotate about a first axis that is offset from the longitudinal axis of the spar to a plurality of orientations relative to the spar, and (ii) release the coupler relative to the spar to allow the coupler to move along the longitudinal axis of the spar.

In some embodiments, the coupler includes a release mechanism that is acted upon by the release to permit rotation of the limb rest about the first axis. In some embodiments, the release mechanism includes an actuator that moves along the first axis when the release is actuated. In some embodiments, the release moves in a direction that is perpendicular to the first axis. In some embodiments, the release mechanism includes a locking plate that is disengaged by the actuator. In some embodiments, the release mechanism includes guides to maintain an orientation of the locking plate. In some embodiments, the guides are positioned on a base member that is secured to the spar. In some embodiments, the guides preclude rotation of the locking plate when the release is actuated and when the release is not actuated. In some embodiments, the locking plate includes anti-rotation features that engage to prevent rotation of the limb rest when the release is not actuated. In some embodiments, the anti-rotation features are disengaged to thereby allow rotation of the limb rest when the release is actuated.

In some embodiments, actuation of the release causes movement of a linkage that causes the coupler to be released from the spar to allow movement of the coupler along the spar. In some embodiments, the linkage transfers motion from a first plunger to cause longitudinal movement of a release member in a direction perpendicular to the movement of the first plunger. In some embodiments, the linkage further comprises an actuator that is pivotable about a second axis that is perpendicular to the first axis. In some embodiments, the linkage comprises a cam that is pivotable about the second axis. In some embodiments, the actuator is secured to the cam. In some embodiments, the cam comprises an axle that has an axis that is collinear with the second axis. In some embodiments, the cam comprises an eccentric that is secured to the axle and rotates therewith. In some embodiments, the eccentric includes a lobe that is offset from the second axis. In some embodiments, the linkage comprises a second plunger that moves between a first position when the release is not actuated and a second position when the release is actuated. In some embodiments, the lobe engages the second plunger. In some embodiments, rotation of the cam about the second axis causes the lobe to move the plunger to release the coupler from the spar.

In some embodiments, the coupler includes a clamp that is selectively actuated to engage the spar to prevent movement of the coupler along the spar. In some embodiments, the clamp is released when the release is actuated. In some embodiments, the second plunger moves to cause the clamp to release the spar.

In some embodiments, the coupler further comprises a rotation lock that prevents rotation of the limb rest about the longitudinal axis of the spar.

In some embodiments, the coupler further comprises a collar that supports the clamp.

In some embodiments, the rotation lock prevents movement of the clamp relative to the collar.

In some embodiments, the rotation lock is releasable to permit rotation of the clamp relative to the collar.

In some embodiments, the rotation lock is adjustable to allow the clamp to be adjusted to a plurality of positions relative to the collar.

In some embodiments, the spar and the collar include a plurality of interengageable anti-rotation elements that cooperate to prevent rotation of the collar about the axis of the spar.

In some embodiments, the coupler includes a selectively engageable brake to prevent movement of the coupler along the longitudinal length of the spar. In some embodiments, when the rotation lock is disengaged, the brake may be disengaged to permit movement of the coupler along the longitudinal length of the spar. In some embodiments, the brake comprises an elastomeric pad.

According to a second aspect of the present disclosure, a limb support comprises a support structure, a limb rest, and a coupler. The support structure is configured to be mounted to a patient support apparatus and includes a spar having a longitudinal axis and a guide tube having a longitudinal axis that is parallel to the longitudinal axis of the spar. The limb rest is configured to support the limb of a patient supported on the patient support apparatus. The coupler is supported from the spar and supports the limb rest. The coupler has a single release that is manually actuable to permit a user to move the release between a locked position and a released position, wherein when the release is in the released position the limb rest is simultaneously adjustable relative to the spar with at least two degrees of freedom.

In some embodiments, when the release is in the released position, the limb rest is simultaneously adjustable relative to the spar with at least four degrees of freedom.

In some embodiments, when the release is in the released position, the limb rest is simultaneously adjustable relative to the spar in at least three degrees of freedom.

In some embodiments, the release is only operable to lock three of the four degrees of freedom.

In some embodiments, the coupler comprises a floating lock member, a biased locking assembly, a fixed lock member, a plurality of wedge members, a plurality of fixed plates, and a shaft engaged with at least one fixed plate. The floating lock member engages the wedge members and the wedge members engage the fixed lock member such that the wedge members induce a load between the wedge members and the fixed plates such that the load of the biased locking assembly is transferred through the wedge members to the plates, the plates thereby inducing a load in the shaft.

In some embodiments, the release is operable to disengage the floating lock member from the wedge members so as to reduce the load induced in the shaft.

In some embodiments, the load induced in the shaft is operable to lock the coupler to the spar.

In some embodiments, the reduction in the load in the shaft releases the coupler from the spar such that the coupler is moveable along the longitudinal axis of the spar.

In some embodiments, the wedge members are coupled together by a bias structure that urges the wedge members to engage the floating lock member and fixed lock member.

In some embodiments, the bias structure coupling the wedge members is insufficient to prevent movement of the limb rest relative to the spar.

In some embodiments, the coupler includes a carriage that is supported on the spar, the carriage including a frame and a lock moveable relative to the frame, the lock being pivoted relative to the frame to secure the carriage to the spar when the load is induced in the shaft.

In some embodiments, the carriage further includes a bias member that is configured to resist the load induced in the shaft. In some embodiments, the load induced in the shaft overcomes the bias of the bias member of the carriage when the load is induced in the shaft by the biased locking assembly. In some embodiments, the bias of the bias member is sufficient to release the lock of the carriage when the load in the shaft is removed.

In some embodiments, the release includes a cam that is rotated to cause the floating lock member to disengage the wedge members.

In some embodiments, the limb rest is rotatable about a third axis, regardless of the position of the release.

In some embodiments, the release is manually actuable between a released position permitting movement of the limb rest about the first axis, about the second axis, and along the spar, and a locked position preventing movement of the limb rest about the first axis, about the second axis, and along the spar.

In some embodiments, the release is configured such that manual actuation achieves a mechanical advantage that overcomes the bias of the biased locking assembly.

In some embodiments, rotation of the coupler about the longitudinal axis of the spar is precluded by a guide member. In some embodiments, the coupler includes a carriage that engages the spar. In some embodiments, the carriage also engages the guide member. In some embodiments, the carriage includes a bias member that biases at least a portion of the carriage into engagement with the guide member. In some embodiments, the carriage further includes at least one needle bearing that engages the guide member. In some embodiments, the carriage includes at least one bearing member that is biased to engage the guide member.

In some embodiments, at least one wedge member includes a feature that limits the range of motion of the limb rest about the first axis.

In some embodiments, the spar further includes a release trigger operable to release the spar for adjustment of the spar relative to a patient support apparatus.

In a third aspect of the present disclosure, a limb support comprises a spar configured to be supported from a patient support apparatus and adjustable relative to the patient support. The spar has a longitudinal axis. The limb support also comprises a limb rest and a coupler interposed between the limb rest and the spar. The coupler includes a release that is selectively actuable to (i) release the limb rest to rotate about a first axis that is offset from and parallel to the longitudinal axis of the spar to a plurality of orientations relative to the spar, (ii) release the limb rest to rotate about a second axis orthogonal to the first axis to a plurality of orientations, and (ii) release the coupler relative to the spar to allow the coupler to move along the longitudinal axis of the spar.

In some embodiments, the release is biased to a locked position to prevent movement of the limb rest relative to the spar.

In some embodiments, the release includes a biased locking assembly that urges a floating lock member to engage a wedge member into engagement with a fixed lock member to urge the release into a locked condition preventing movement of the limb rest about the first and second axis and preventing movement of the coupler along the longitudinal axis of the spar.

In some embodiments, the floating lock member engages two wedge members; the two wedge members each engaging the fixed lock member in the locked condition.

In some embodiments, the wedge members each engage a fixed plate such that the load of the bias member is transferred through the wedge members to the plates, the plates cooperating to induce a load in a shaft.

In some embodiments, the load on the shaft is transferred to a lock that engages the spar to secure the coupler to the spar.

In some embodiments, the release includes a cam that is rotated to cause the floating lock member to disengage the wedge members.

In some embodiments, the limb rest is rotatable about a third axis, regardless of the position of the release.

In some embodiments, the release is manually actuable between a released position permitting movement about the first axis, about the second axis, and along the spar, and a locked position preventing movement about the first axis, about the second axis, and along the spar.

In some embodiments, the release is configured such that manual actuation achieves a mechanical advantage that overcomes the bias member.

In some embodiments, rotation of the coupler about the longitudinal axis of the spar is precluded by a guide member. In some embodiments, the coupler includes a carriage that engages the spar. In some embodiments, the limb support further comprises an elongate guide member that is parallel to the spar and the carriage further engages the guide member. In some embodiments, the carriage includes a bias member that biases at least a portion of the carriage into engagement with the guide member. In some embodiments, the carriage further includes at least one needle bearing that engages the guide member. In some embodiments, the carriage includes at least one bearing member that is biased to engage the guide member.

In some embodiments, at least one wedge member includes a feature that limits the range of motion of the limb rest about the first axis.

In some embodiments, the floating lock ring includes a first annular surface that engages one or more wedge members, the fixed lock ring includes a second annular surface that engages one more wedge members, and wherein the one or more wedge members are free to move relative to the first and second annular surfaces when the release is in the released position.

In some embodiments, the coupler further comprises a floating lock member, a biased locking assembly, a fixed lock member, a wedge member, a fixed plate, and a shaft engaged with the fixed plate, wherein the floating lock member engages the wedge member to induce a load between the wedge member and the fixed plate such that the load of the biased locking assembly is transferred through the wedge member to the plate, the plate inducing a load in the shaft.

In some embodiments, the release is operable to disengage the floating lock member from the wedge member so as to reduce the load induced in the shaft. In some embodiments, the load induced in the shaft is operable to lock the coupler to the spar. In some embodiments, the reduction in the load in the shaft causes the coupler to release the coupler from the spar such that the coupler is moveable relative to the spar.

In some embodiments, the coupler further comprises a floating lock member, a biased locking assembly, a fixed lock member, a plurality of wedge members, a plurality of fixed plates, and a shaft engaged with at least one fixed plate, wherein the floating lock member engages the wedge members and the wedge members engage the fixed lock member such that the wedge members induce a load between the wedge members and the fixed plates such that the load of the biased locking assembly is transferred through the wedge members to the plates, the plates inducing a load in the shaft.

In some embodiments, the release is operable to disengage the floating lock members from the wedge member so as to reduce the load induced in the shaft. In some embodiments, the load induced in the shaft is operable to lock the coupler to the spar. In some embodiments, the reduction in the load in the shaft causes the coupler to release the coupler from the spar such that the coupler is moveable relative to the spar.

In some embodiments, the wedge members are coupled together by a bias structure that urges the wedge members to engage the floating lock member and fixed lock member. In some embodiments, the bias structure coupling the wedge members is insufficient to cause the wedge members to prevent movement of the limb rest relative to the spar.

In some embodiments, the coupler includes a carriage that is supported on the spar, the carriage including a frame and a lock moveable relative to the frame, the lock being biased relative to the frame to secure the carriage to the spar when the load is induced in the shaft.

In some embodiments, the carriage further includes a bias member that is configured to resist the load of the shaft. In some embodiments, the load of the shaft overcomes the bias of the bias member of the carriage when the load is induced in the shaft. In some embodiments, the bias of the bias member is sufficient to release the lock of the carriage when the load in the shaft is removed.

In some embodiments, the release includes a cam that is rotated to cause the floating lock member to disengage the wedge member.

According to a fourth embodiment of the present disclosure a coupler is configured to support a limb rest relative to a support structure. The coupler includes a release that is selectively actuable to (i) release the limb rest to rotate about a first axis, (ii) release the limb rest to rotate about a second axis orthogonal to the first axis to a plurality of orientations, and (ii) release the coupler for movement along the longitudinal axis of the support structure.

In some embodiments, the release is biased to a locked position to prevent movement of the limb rest relative to the support structure.

In some embodiments, the release includes a biased locking assembly that urges a floating lock member to engage a wedge member into engagement with a fixed lock member to urge the release into a locked condition preventing movement of the limb rest about the first and second axes and preventing movement of the coupler relative to the support structure.

In some embodiments, the floating lock member engages two wedge members; the two wedge members each engaging the fixed lock member in the locked condition.

In some embodiments, the wedge members each engage a fixed plate such that the load of the bias member is transferred through the wedge members to the plates, the plates cooperating to induce a load in a shaft.

In some embodiments, the load on the shaft is transferred to a lock that engages the support structure to secure the coupler to the support structure.

In some embodiments, the release includes a cam that is rotated to cause the floating lock member to disengage the wedge member.

In some embodiments, a limb rest mounting plate is rotatable about a third axis, regardless of the position of the release.

In some embodiments, the release is manually actuable between a released position permitting movement about the first axis, about the second axis, and along the support structure, and a locked position preventing movement about the first axis, about the second axis, and along the support structure.

In some embodiments, the release is configured such that manual actuation achieves a mechanical advantage that overcomes the bias member.

In some embodiments, the coupler includes a guide channel configured to engage a guide member of the support structure to maintain an orientation of the coupler as it moves along the spar.

In some embodiments, the coupler includes a carriage that is configured to engage the support structure.

In some embodiments, the carriage configured to engage the guide member.

In some embodiments, the carriage includes a bias member that is configured to bias at least a portion of the carriage into engagement with the guide member.

In some embodiments, the carriage further includes at least one needle bearing configured to engage the guide member.

In some embodiments, the carriage includes at least one bearing member that is biased to engage the guide member.

In some embodiments, at least one wedge member includes a feature that limits the range of motion of the limb rest about the first axis.

In some embodiments, the floating lock ring includes a first annular surface that engages one or more wedge members, the fixed lock ring includes a second annular surface that engages one more wedge members, and wherein the one or more wedge members are free to move relative to the first and second annular surfaces when the release is in the released position.

In some embodiments, the coupler further comprises a floating lock member, a biased locking assembly, a fixed lock member, a wedge member, a fixed plate, and a shaft engaged with the fixed plate, wherein the floating lock member engages the wedge member to induce a load between the wedge member and the fixed plate such that the load of the biased locking assembly is transferred through the wedge member to the plate, the plate inducing a load in the shaft.

In some embodiments, the release is operable to disengage the floating lock member from the wedge member so as to reduce the load induced in the shaft.

In some embodiments, the load induced in the shaft is configured to lock the coupler to the support structure.

In some embodiments, a reduction in the load in the shaft is configured to release the coupler from the support structure such that the coupler is moveable relative to the support structure.

In some embodiments, the coupler further comprises a floating lock member, a biased locking assembly, a fixed lock member, a plurality of wedge members, a plurality of fixed plates, and a shaft engaged with at least one fixed plate, wherein the floating lock member engages the wedge members and the wedge members engage the fixed lock member such that the wedge members induce a load between the wedge members and the fixed plates such that the load of the biased locking assembly is transferred through the wedge members to the plates, the plates inducing a load in the shaft.

In some embodiments, the release is operable to disengage the floating lock member from the wedge member so as to reduce the load induced in the shaft.

In some embodiments, the load induced in the shaft is configured to lock the coupler to the support structure.

In some embodiments, the reduction in the load in the shaft is configured to release the coupler from the support structure such that the coupler is moveable relative to the support structure.

In some embodiments, the wedge members are coupled together by a bias structure that urges the wedge members to engage the floating lock member and fixed lock member.

In some embodiments, the bias structure coupling the wedge members is insufficient to cause the wedge members to prevent movement of the limb rest support plate relative to the support structure.

In some embodiments, the coupler includes a carriage that is configured to be on the support structure, the carriage including a frame and a lock moveable relative to the frame, the lock being biased relative to the frame to the secure the carriage to the support structure when the load is induced in the shaft.

In some embodiments, the carriage further includes a bias member that is configured to resist the load of the shaft.

In some embodiments, the load of the shaft overcomes the bias of the bias member of the carriage when the load is induced in the shaft.

In some embodiments, the bias of the bias member is sufficient to release the lock of the carriage when the load in the shaft is removed.

In some embodiments, the release includes a cam that is rotated to cause the floating lock member to disengage the wedge member.

In some embodiments, the limb rest support plate is rotatable about a third axis, regardless of the position of the release.

In some embodiments, the release is manually actuable between a released position permitting movement of the limb rest support plate about the first axis, about the second axis, and along the support structure, and a locked position preventing movement of the limb rest support plate about the first axis, about the second axis, and along the support structure.

In some embodiments, the release is configured such that manual actuation achieves a mechanical advantage that overcomes the bias member.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
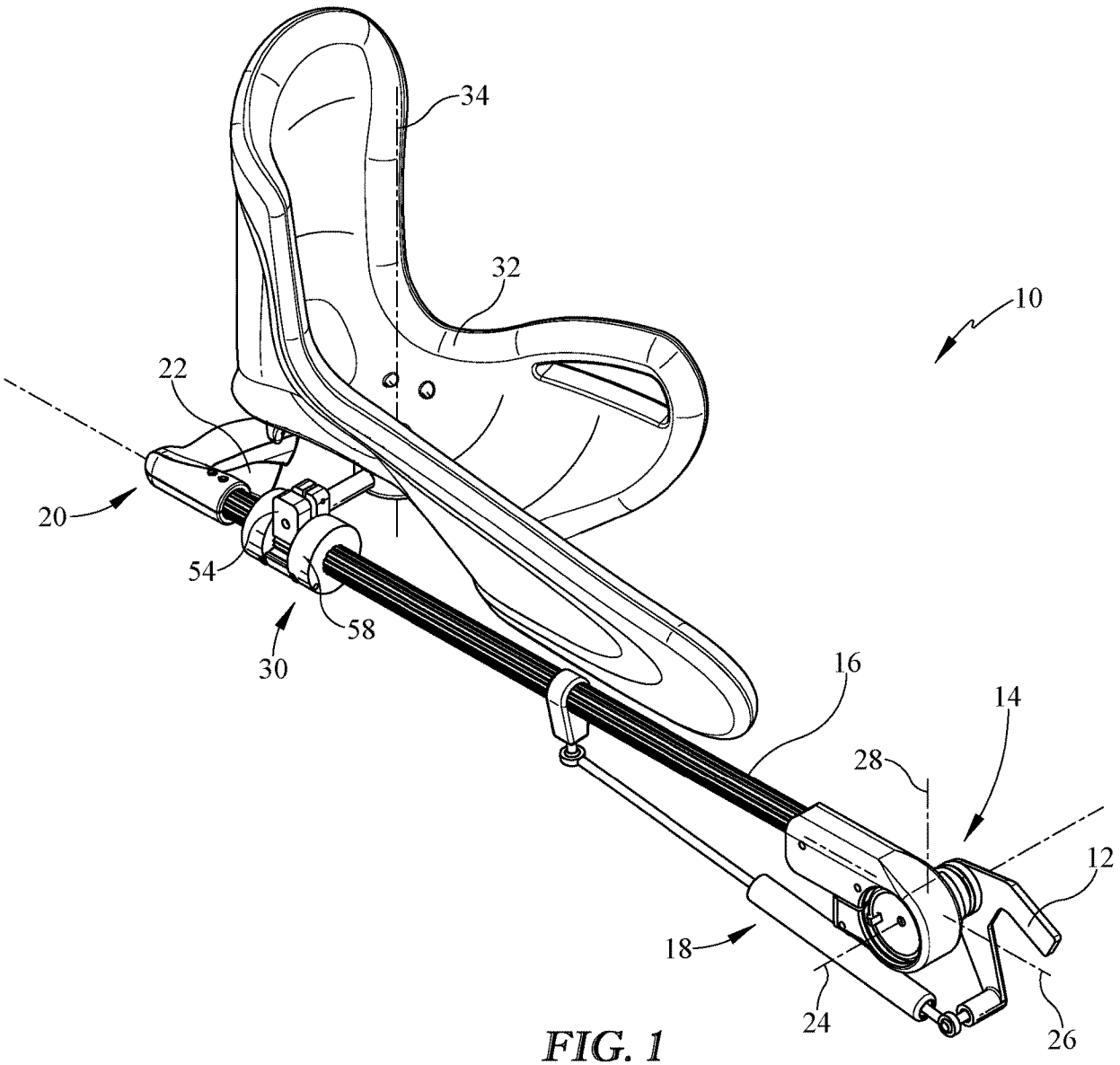
FIG. 1 is a perspective view of a limb support for use during surgery, the limb support configured to be mounted to a patient support apparatus.

A limb support configured as a leg support 10 mountable to a patient support apparatus (not shown) and for positioning the leg of a patient in a number of different positions is shown in FIG. 1. The leg support 10 includes a mount 12 for mounting the leg support 10 to a patient support apparatus as is known in the art. The mount 12 supports a lockable multi-axis coupler 14 that supports a spar 16 illustratively embodied as a rod and permits movement of the spar 16 relative to the mount 12 in a plurality of directions. An illustrative coupler suitable for use as coupler 14 is disclosed in U.S. Pat. No. RE41412E1, titled "LEG HOLDER SYSTEM FOR SIMULTANEOUS POSITIONING IN THE ABDUCTION AND LITHOTOMY DIMENSIONS" which is incorporated by reference herein for the subject matter related to the implementation of a lockable multi-axis coupler 14.

The spar 16 is supported relative to the mount 12 by a counterbalancing gas spring 18 which assists in supporting the weight of a patient's leg when the leg support 10 is in use or the position is being adjusted. A handle 20 positioned on a distal end of the spar 16 relative to the mount 12 is configured to be used by a user to position the spar 16 and includes a release trigger 22 that, when gripped by a user, causes the lockable multi-axis coupler 14 to be released to allow the spar 16 to move relative to the mount 12. Movement of the spar 16 relative to the mount 12 is facilitated in the pitch axis 24, roll axis 26, and yaw axis 28 as suggested in FIG. 1. In the illustrative embodiment, this permits abduction, adduction, and lithotomy adjustments of the patient's leg. In should be understood that the movement could be equally applicable to a patient's arm.

The illustrative leg support 10 is configured to support a patient's left leg. In many cases, a second leg support that is a mirror duplicate of the leg support 10 will be used to support the right leg of a patient. The present disclosure includes an adjustable coupler 30 that permits of adjustment of the relative position and orientation of a limb rest 32 relative to the spar 16. As will be explained in further detail below, the adjustable coupler 30 permits discrete adjustment of the position of the limb rest 32 about the spar 16 that provides additional roll axis adjustment of the limb rest 32. Still further, the limb rest 32 may be rotated about an axis 34 shown in FIG. 1 to change the orientation of the limb rest 32 relative to the spar 16.

Figure 2:
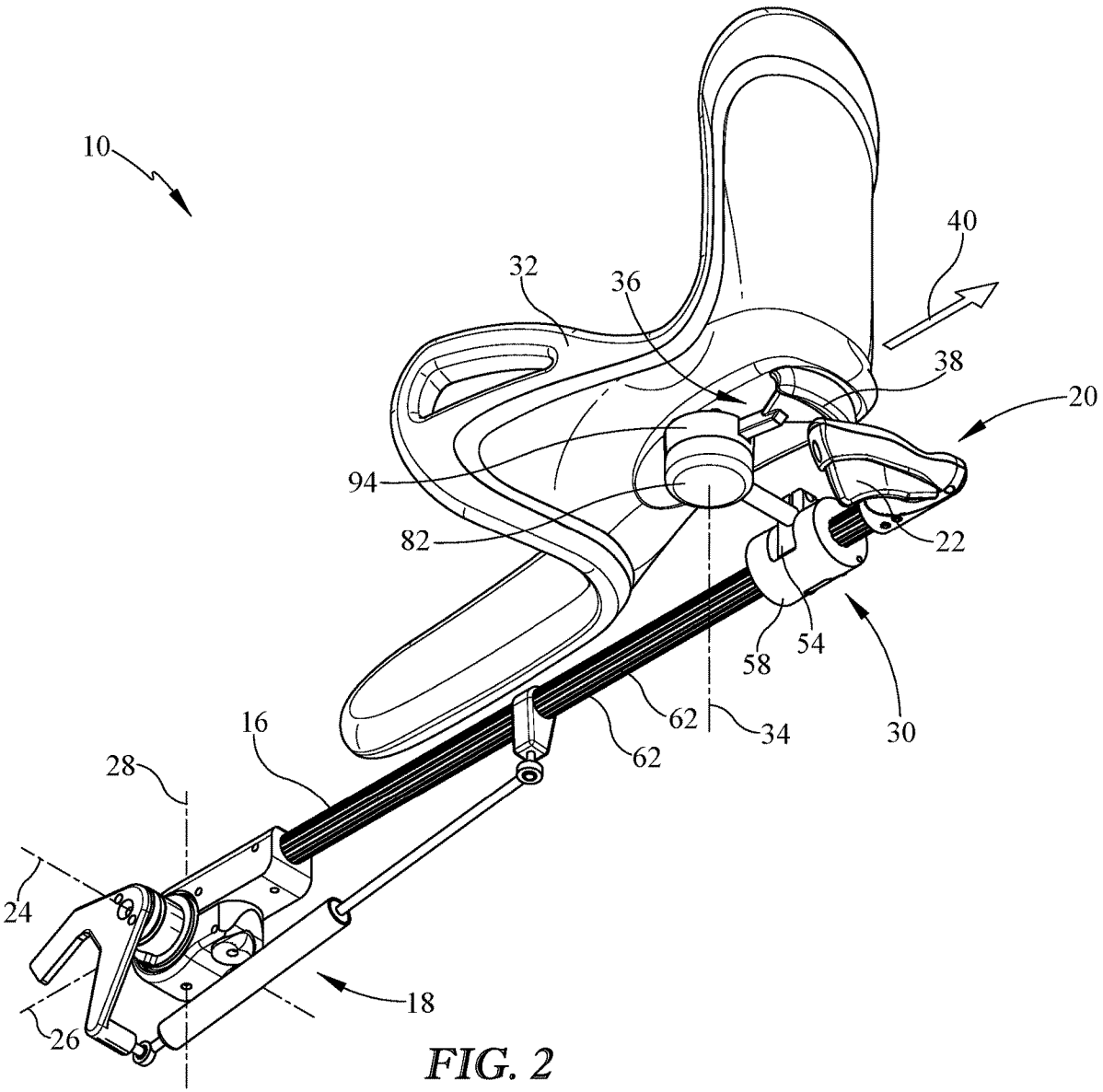
FIG. 2 is another view of the limb support of FIG. 1 viewed from a different perspective.

Referring to FIG. 2, the adjustable coupler 30 includes a release 36 that includes a handle 38 that may be pulled in the direction of arrow 40 to move the release 36 in the direction of arrow 40 shown in FIG. 2. As will be described in further detail below, the movement of release 36 in the direction of arrow 40 is transferred by a cam action to a plunger 42 to move the plunger 42 between a first position shown in FIG. 4 and a second position shown in FIG. 5. The movement of plunger 42 causes a locking mechanism 44 of the adjustable coupler 30 to be released to permit movement of a portion of the coupler 30 relative to a limb rest support plate 94 about the axis 34 to change the orientation of the limb rest 32 relative to the spar 16.

Figure 6:
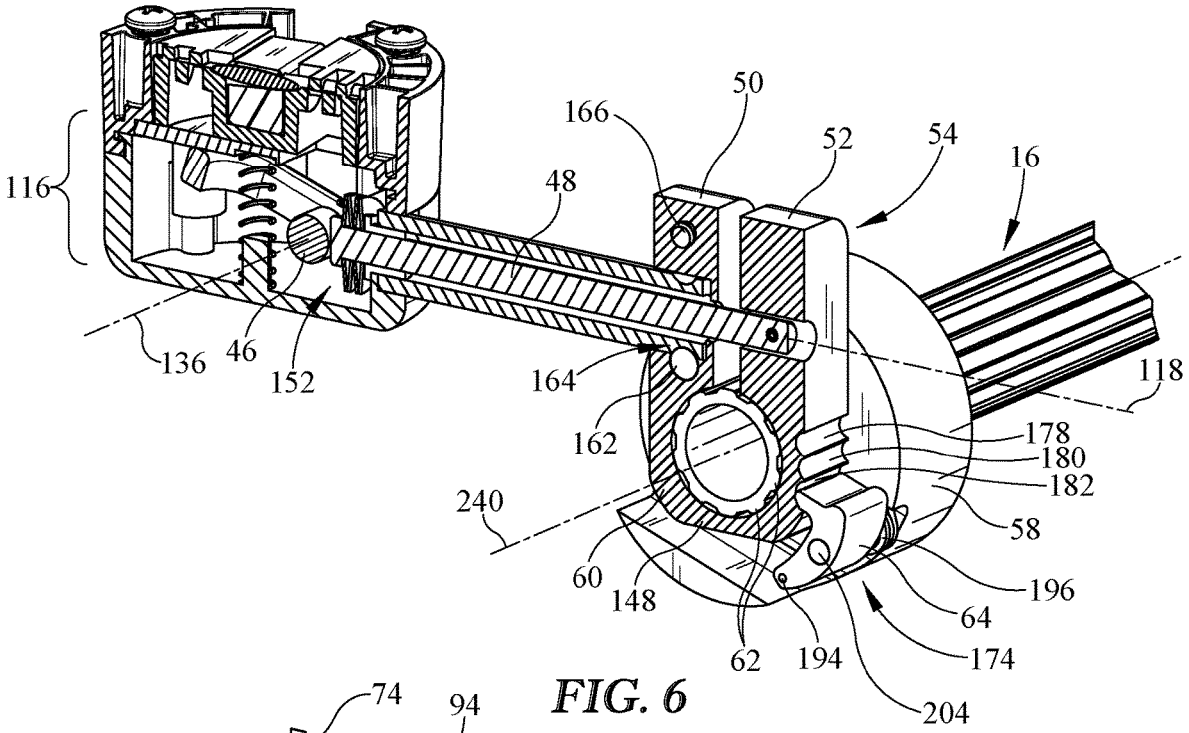
FIG. 6 is a cross-sectional view of a portion of the coupler of FIG. 3 and the spar when the release is in the first, non-released position of FIG. 4.
Figure 7:
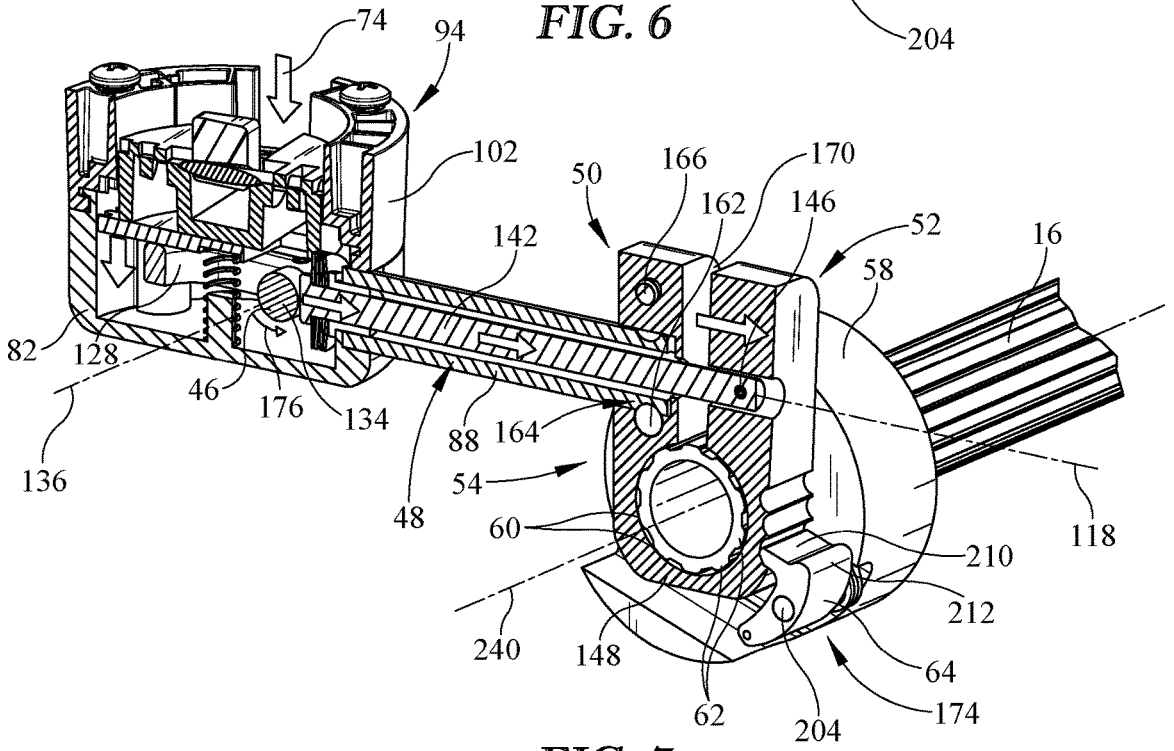
FIG. 7 is a cross-sectional view similar to FIG. 6 when the release is in the second, released position.

In addition, the downward movement of the plunger 42 is transferred to an actuator 46 which acts on a plunger 48 to move the plunger 48 between the first position shown in FIG. 6 and a second position shown in FIG. 7. In the second position, the plunger 48 separates a first leg 50 and a second leg 52 of a clamp 54 to release the clamp 54 relative to the spar 16 and thereby allow the coupler 30 to move along the length of the spar 16 to change the distance between the coupler 30 and the mount 12. A bias member 80 urges the locking mechanism 44 to re-engage and allows the actuator 46 to return to the first position shown in FIGS. 4 and 6 so that the limb rest 32 is fixed relative to the spar 16. In addition to the bias of bias member 80, which is illustratively embodied as a coil spring, the plunger 48 is urged to the first position by a bias assembly 152, illustratively embodied as a embodied as a group of Belleville washers, and by the bias the clamp 54, which will be discussed in further detail below.

Referring again to FIG. 1, the clamp 54 is supported in a collar 58 which includes a number of grooves 60 (best seen in FIG. 3) which engage longitudinal ribs 62 formed about the outer surface of the spar 16. The interaction of the grooves 60 and ribs 62 preclude rotation of the collar 58 about the spar 16. The clamp 54 is fixed to the collar 58 by a spring-biased lock arm 64 which locks the clamp 54 relative to the collar 58 to prevent rotation of the clamp 54 about the spar 16. However, as will be discussed in further detail below, the lock arm 64 permits the clamp 54 to be positioned in multiple different orientations relative to the collar 58 by releasing the lock arm 64, moving the clamp 54 about the spar 16, and re-engaging the lock arm 64 with the clamp 54 to secure the clamp 54 in the new orientation.

Figure 3:
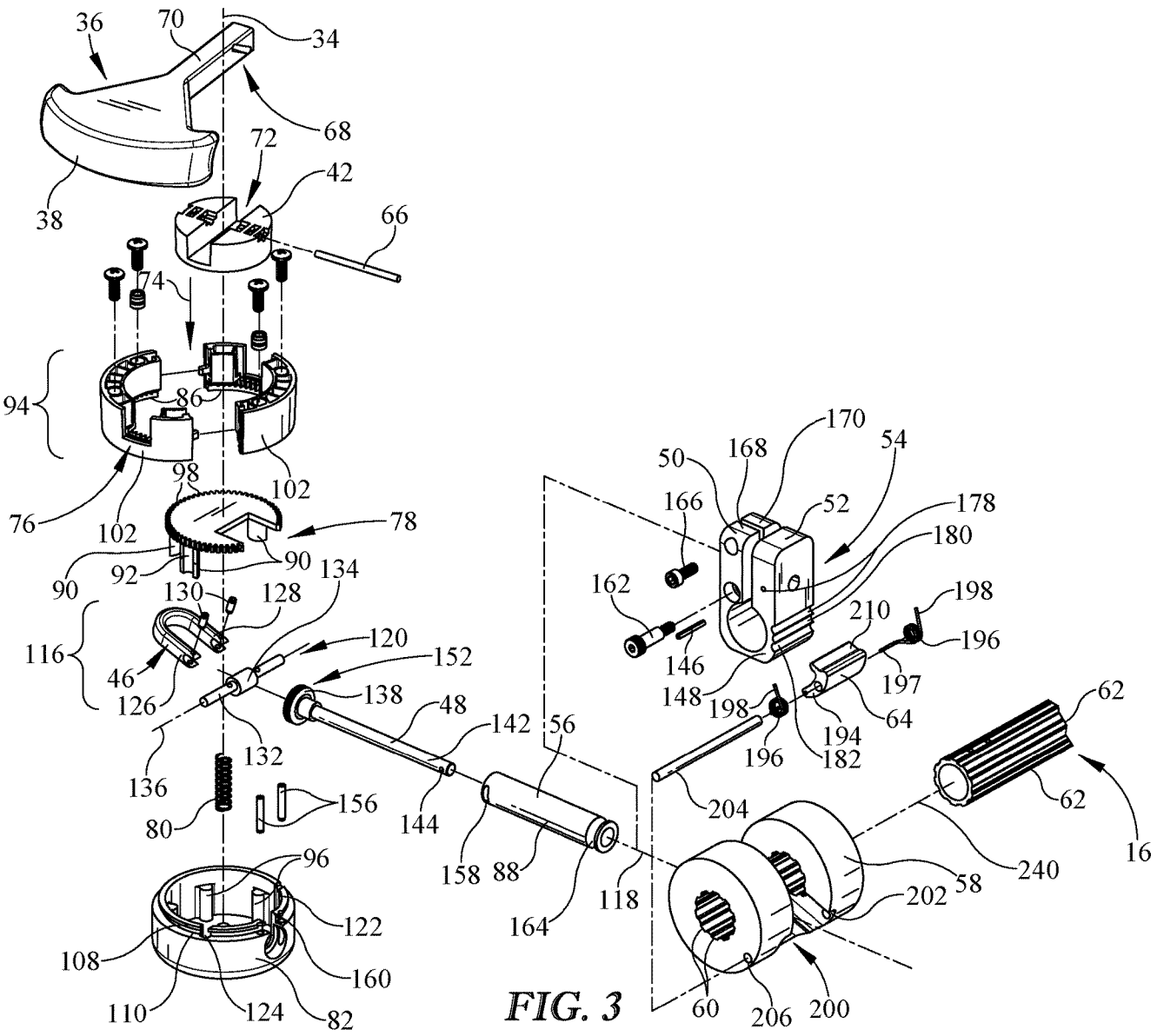
FIG. 3 is an exploded view of a coupler of the limb support of FIG. 1, the coupler operable to support and adjust a limb rest relative to a spar of the limb support.

To explain in further detail, the coupler 30, shown in an exploded view in FIG. 3, includes the release 36 which engages the plunger 42 through a pin 66 that is fixed to the plunger 42 and received in an inclined guide 68 formed in a body 70 of the release 36. The body 70 is positioned in a channel 72 formed in plunger 42 and is moveable relative to the plunger 42. Movement of the release 36 in the direction of arrow 40 causes the pin 66 to be acted upon by the inclined guide 68, which through a cam action urges the pin 66 downwardly in the direction of an arrow 74 which is parallel to axis 34. The release body 70 is supported in a channel 76 of the limb rest support plate 94 and trapped between the limb rest support plate 94 and the limb rest 32 so that the force applied to the release 36 is applied to the plunger 42 as all other movement is restrained by the assembly of the release 36 to the limb rest support plate 94.

A lock plate 78 is supported on a spring 80 which is trapped between lock plate 78 and a base 82 of the coupler 30. The spring 80 biases the lock plate 78 upwardly and, through the lock plate 78 biases the plunger 42 in the direction opposite the arrow 74. This bias urges the release 36 to the first position shown in FIG. 4. The lock plate 78 includes a number of teeth 98 formed about an outer edge 84. The teeth 98 are configured to mate with grooves 86 formed in the limb rest support plate 94 when the lock plate 78 is in the first position. When the bias of the spring 80 is overcome and the lock plate 78 dis-engages the limb rest support plate 94, the limb rest support plate 94 is free to rotate about the axis 34. This movement is permitted as the base 82 is fixed to the clamp 54 through an arm 88 and the lock plate 78 is fixed against rotation relative to the base 82 by a number of legs 90 which have channels 92 that receive protrusions 96 formed in the base 82. The legs 90 of the lock plate 78 are free to move relative to the protrusions in the direction of arrow 74. However, when the lock plate 78 is engaged with the teeth 98 of the limb rest support plate 94, the limb rest support plate 94 is precluded from rotation about the axis 34 through the engagement of the lock plate 78 with the base 82 and the connection between the base 82 and the arm 88 that is fixed to the base 82 and the clamp 54.

Figure 4:
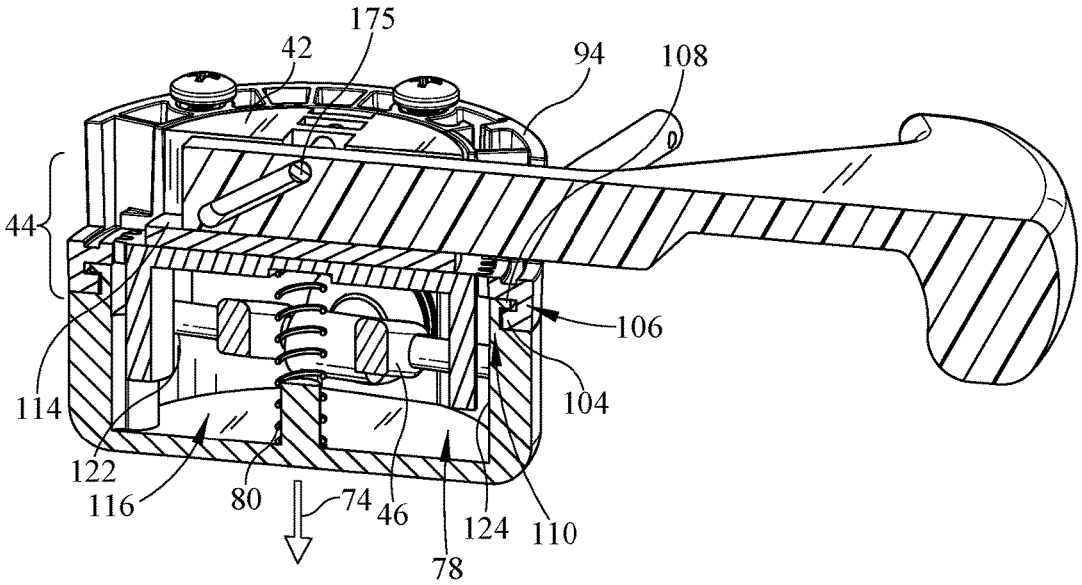
FIG. 4 is a cross-sectional view of a portion of the coupler of FIG. 3 with a selectively actuable release in a first, non-released position.
Figure 5:
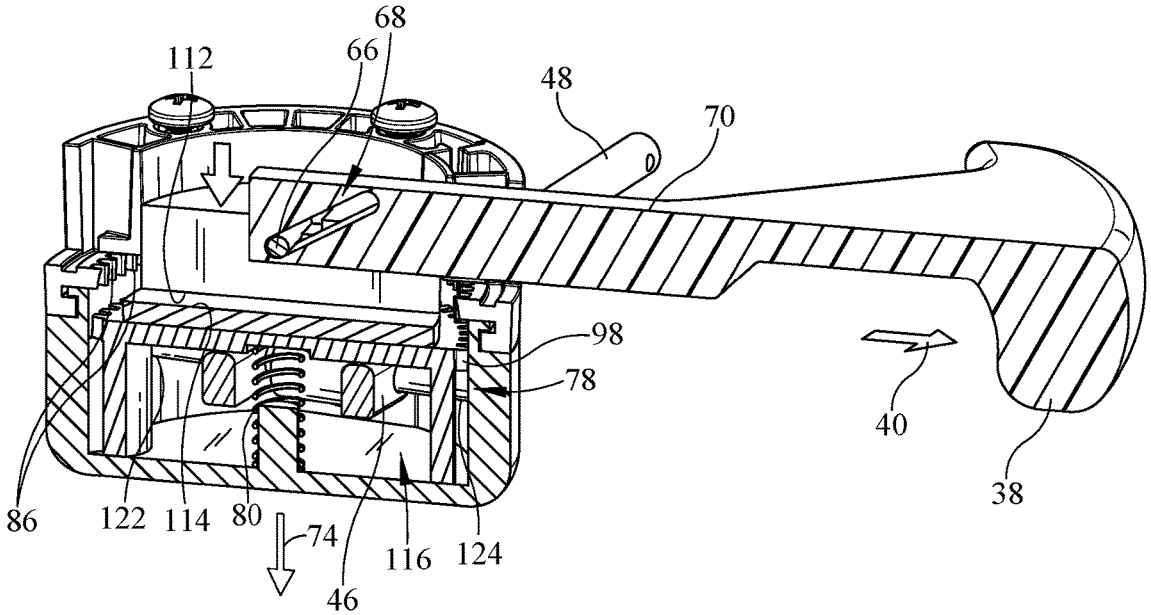
FIG. 5 is a cross-section similar to FIG. 4 with the release in a second, released position.

Referring to FIG. 3, it should be noted that the illustrative limb rest support plate 94 comprises two identical half-rings 102 that are engaged together to form the limb rest support plate 94. As illustrated in FIGS. 4 and 5, the half-rings 102 are formed such that when the half-rings 102 are assembled, the limb rest support plate 94 is formed to include a flange 104 which underlies a groove 106 on the lower annular edge of the limb rest support plate 94. The base 82 is formed to include flange 108 which overlies a groove 110 which, when the half-rings 102 are assembled over the base 82, engage the respective groove 106 and flange 104 of the limb rest support plate 94. When coupler 30 is secured to the limb rest 32, the base 82 and the limb rest support plate 94 are secured together so that there is no movement of the base 82 relative to the limb rest support plate 94. The lock plate 78 is constrained to move between the first positon of FIG. 4 and the second position of FIG. 5 as the plunger 42 moves. A lower surface 112 of the plunger 42 engages an upper surface 114 of the lock plate 78 but is movable about the axis 34 when the release 36 is moved in the direction of arrow 40 to the second position of FIG. 5.

Figure 9:
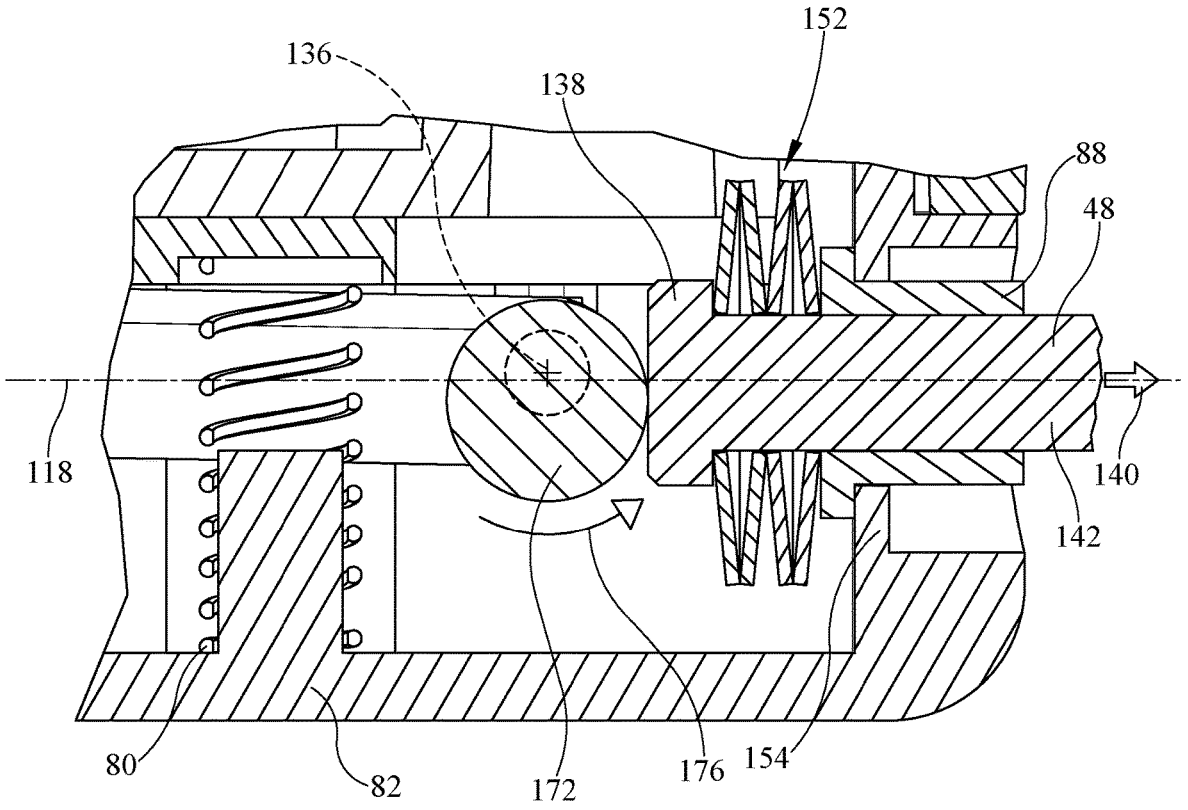
FIG. 9 is cross-sectional view of a portion of the coupler of FIG. 3, FIG. 9 illustrating the action of the lobe of a cam of a release linkage acting on a plunger to cause a portion of the coupler to be released from the spar.

While the movement of the lock plate 78 permits the adjustment of the limb rest support plate 94 about axis 34, a separate linkage 116 transfers the movement of the plunger 42 in the direction of axis 34 to movement of the plunger 42 along an axis 118 which is perpendicular to axis 34. The linkage 116 includes the actuator 46 and a cam 120 which is supported on trunnions 122 and 124 formed in the base 82. The actuator 46 is a u-shaped member with two legs 126 and 128 that are secured to the cam 120 by pins 130, 130. The cam 120 includes an axle 132 and an eccentric 134 secured to the axle 132. Rotation of the cam 120 about an axis 136 of the axle 132 causes the eccentric 134 to rotate as suggested in FIG. 9 so that the eccentric acts on a head 56 of the plunger 42 to urge the plunger 42 along axis 118 as suggested by the arrows 140 shown in FIG. 7.

The plunger 42 includes a shaft 142 that has a cross-hole 144 through which a pin 146 (shown in FIG. 3) inserted. The pin 146 is also received in the leg 52 of clamp 54 so that movement of the shaft 142 acts on leg 52 to urge leg 52 away from leg 50 of the clamp 54. The clamp 54 is resiliently flexible and has a latent bias that is created by the web 148 of the clamp 54. The arm 88 is secured to the leg 50 of the clamp 54. The arm 88 is also secured to the base 82 by having a head 56 retain the bias assembly 152 inside a wall 154 of the base 82. The arm 88 is further restrained by two pins 156, 156 which are inserted into grooves 158, 158 formed in the arm 88. The pins 156, 156 are positioned in the grooves 158, 158 and received in two holes 160, 160 formed in the base 82 to fix the arm 88 to the base 82. A machine screw 162 is positioned in the leg 50 of the clamp 54 and received in a groove 164 of arm 88 to prevent the arm 88 from moving relative to the leg 50. A second machine screw 166 is positioned in a first side 168 of leg 50 and threaded into a second side 170 of leg 50 to add additional clamping force to the arm 88.

The plunger 48 being pinned to the leg 52 and free to move within an relative to the arm 88, effects movement of leg 52 relative to leg 50 to overcome the bias of the web 148. Thus, as the eccentric 134 rotates, a lobe 172 of the eccentric 134 engages the head 56 of plunger 48 to move the plunger 138 along axis 118 and cause the clamp 54 to release. The eccentric 134 is rotated by the action of a bottom surface 175 of the lock plate 78 on the actuator 46 to thereby cause the linkage 116 to pivot about the axis 136 as the plunger 42 is urged downwardly. Rotation of the eccentric 134 about the axis 136 in the direction of arrow 176 shown in FIG. 7 causes the lobe 172 to engage the head 56 and urge the plunger 48 along axis 118 to release the clamp 54. The bias of the web 148 and the bias assembly 152 urge the plunger 48 in the direction opposite the arrow 140. Thus, as the release 36 is released by a user, the lock plate 78 is urged to engage the limb rest support plate 94 and permits movement of the linkage 116 such that the cam 120 and actuator 46 pivot about axis 136 to return to the position shown in FIG. 6.

It should be noted that the action of releasing both the locking mechanism 44 and the linkage 116 result from the cooperation of the actuator 46 and the lock plate 78. However, in other embodiments, the clamp release could be omitted by omitting the linkage 116 and having only a rotation release as described relative to locking mechanism 44. Similarly, locking mechanism 44 could be omitted and the plunger 42 could act directly on the actuator 46 such that an embodiment of the coupler 30 could include only the linkage 116 that releases the clamp 54.

Figure 8:
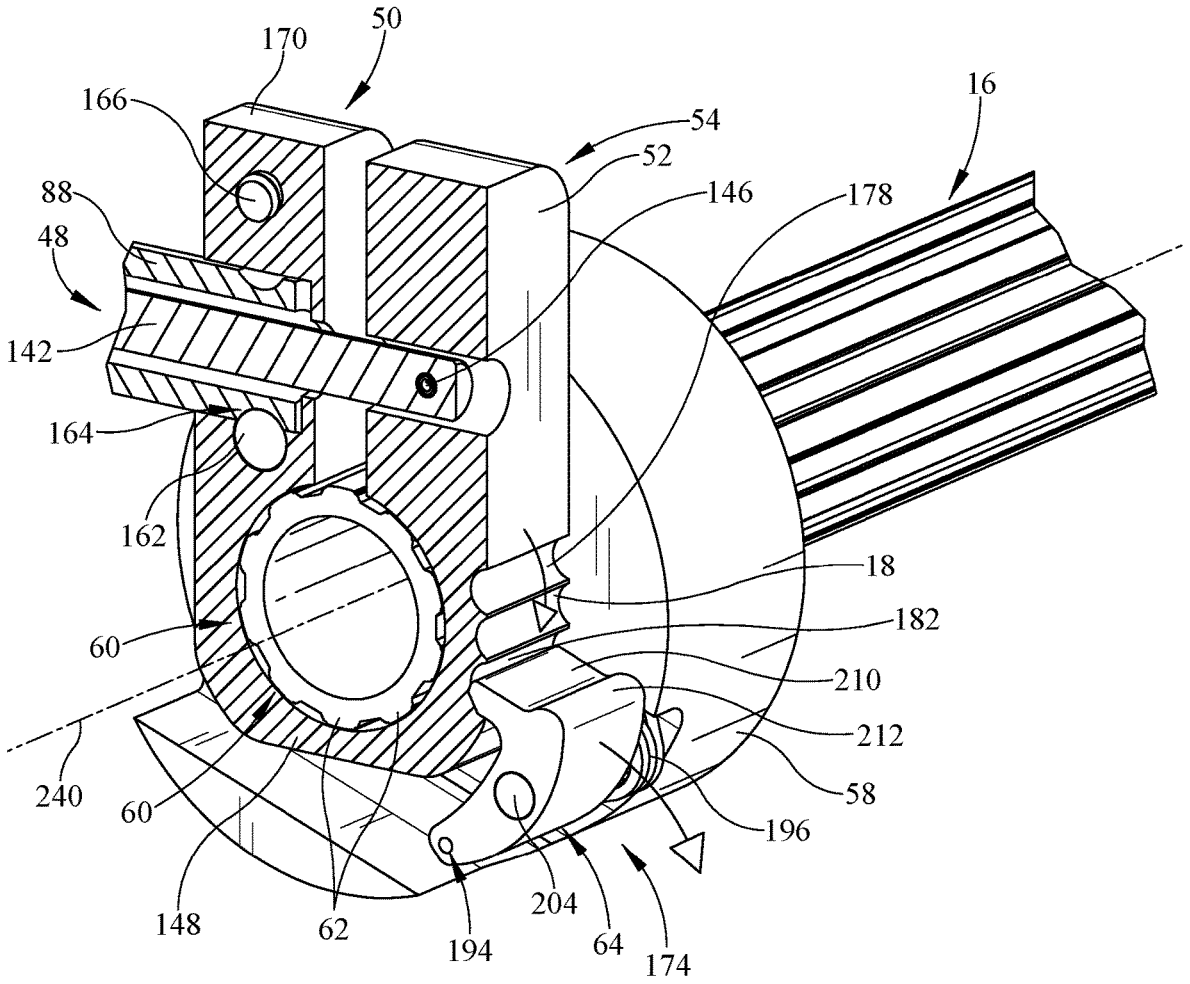
FIG. 8 is a partial cross-sectional view of a portion of the coupler of FIG. 3 engaged with the spar, FIG. 8 showing components of a rotation lock that selectively prevents rotation of portions of the coupler about the longitudinal axis of the spar.

Heretofore, the clamp 54 has been described as having a constant relationship relative to the collar 58. In the illustrative embodiment, the orientation of the clamp 54 about the axis 240 of the spar 16 is adjustable to a number of locations by releasing a clamp lock 174 and rotating the clamp 54 about the axis 240 of spar 16 as indicated by arrow 176 in FIG. 8. The clamp lock 174 includes the lock arm 64 which is pivotable relative to the collar 58 and a series of grooves 178, 180, and 192 formed on the clamp 54. When the clamp 54 is released by the release 36 and the clamp lock 174 is released, the clamp 54, and the remainder of coupler 30, is movable relative to the collar 58. The lock arm 64 is formed to include a pair of receivers 194, 194 on opposite ends. The receivers 194 each receive a leg 197 of a respective bias member 196, illustratively embodied as a spring. The each spring 196 has another leg 198 that is received in one of two receivers 200, 202 formed in the collar 58. The lock arm 64 is positioned on a pin 204 which is received in a hole 206 formed in the collar 58 and which defines a pivot axis 208 about which the lock arm 64 pivots. The bias member 196 urges a flange 210 of the lock arm 64 into engagement with one of the grooves 178, 180, and 192 formed on the clamp 54 which thereby locks the clamp 54 relative to the collar 58. To release the clamp 54 a user applies sufficient pressure to a handle 212 of the lock arm 64 to overcome the bias of the bias member 196 and thereby disengage the flange 210 from the respective groove 178, 180, and 192.

Figure 10:
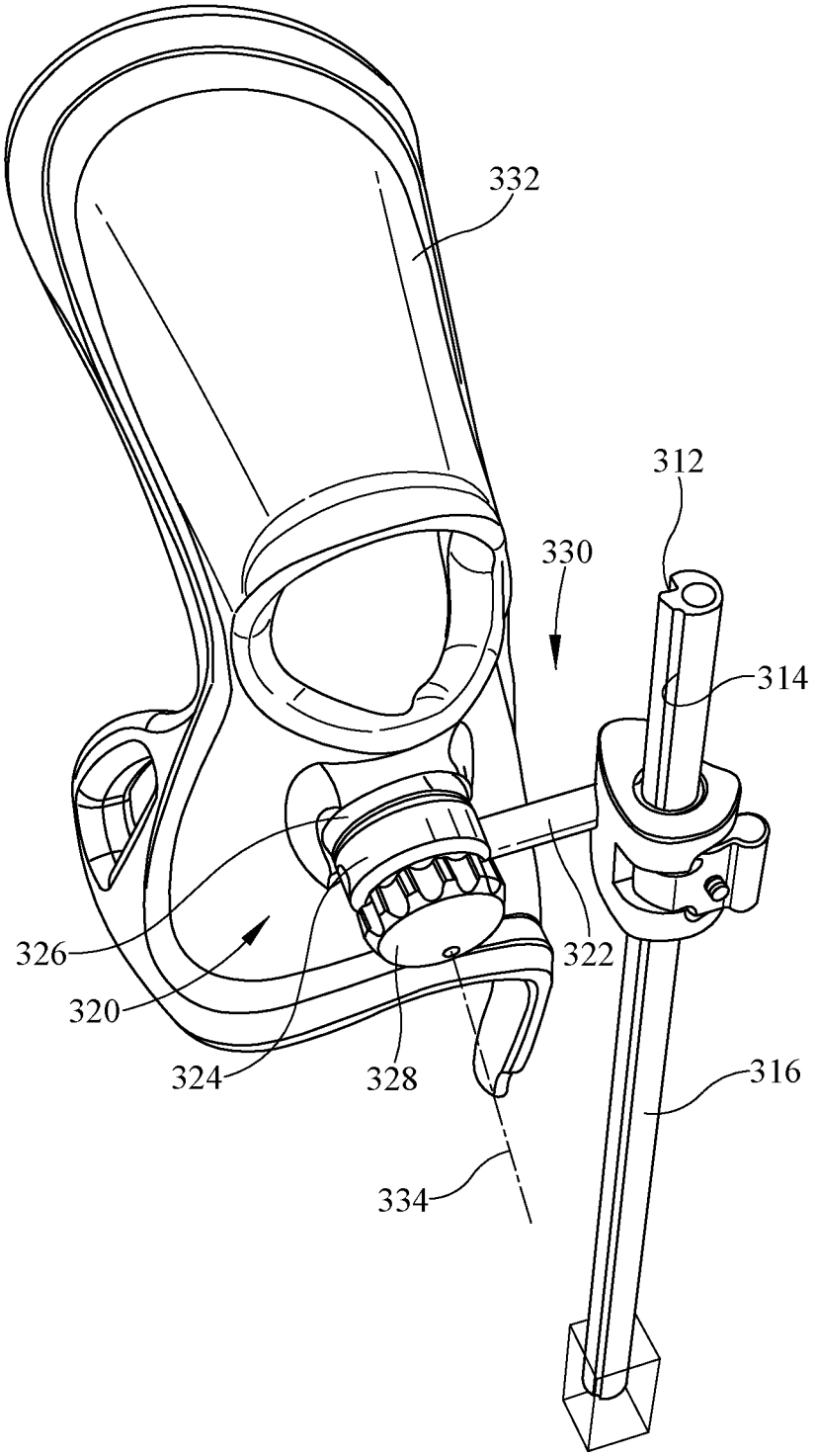
FIG. 10 is a perspective view of another embodiment of a limb support with a different coupler.
Figure 11:
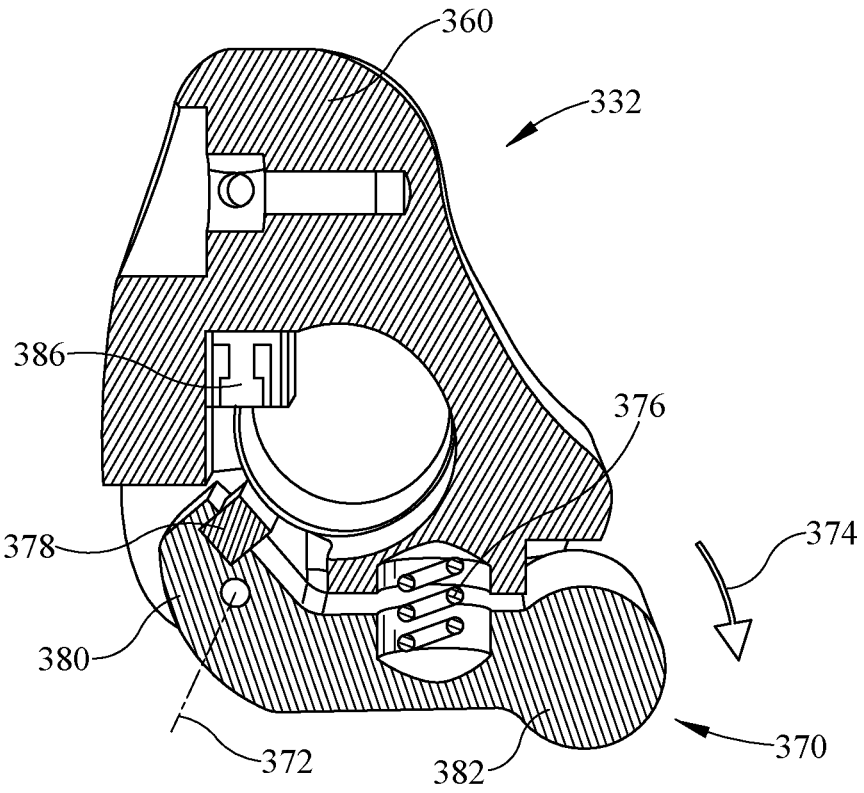
FIG. 11 is a cross-sectional view of a collar of the coupler of the limb support of FIG. 10.
Figure 12:
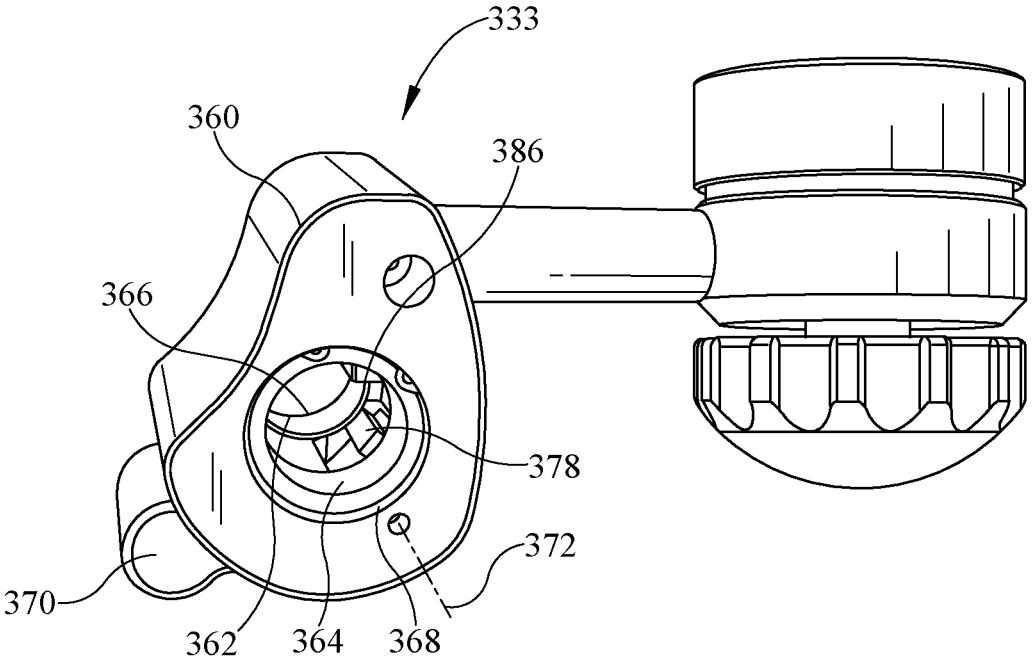
FIG. 12 is perspective view of the coupler of the limb support of FIG. 10.

In another embodiment shown in FIGS. 10-12, a leg support 310 includes a limb rest 332 supported by a coupler 330 relative to a spar 316. As will the locking of the limb rest relative to a rotation axis 334 is accomplished with an action that is separate from the locking of the coupler 330 relative to the spar 316. The coupler 330 includes a collar 333 that engages the spar 316. The spar 316 is formed with two channels 312 and 314 formed along the longitudinal length of the spar 316. The upper channel 312 acts to prevent rotation of the collar 333 relative to the spar 316 as will be discussed in further detail below.

Figure 13:
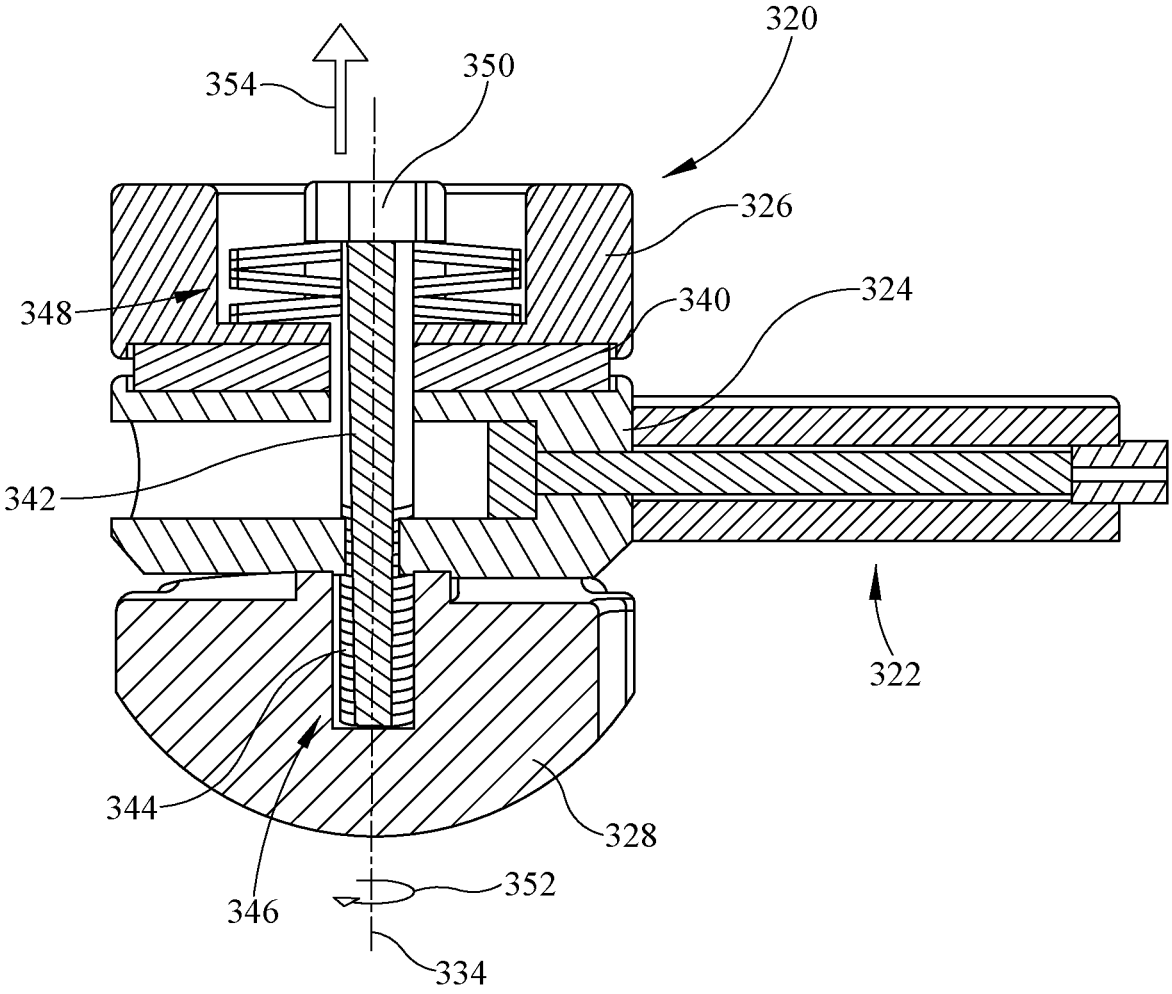
FIG. 13 is a cross-sectional view of a clamp of the coupler of FIG. 10, the clamp operable to prevent rotation of a limb rest relative to the spar of the limb support.

As shown in FIG. 10, the coupler 330 includes a clamp 320 that is supported from the collar 333 by an arm 322. The arm 322 is fixed to both the collar and the clamp 320. The clamp 320 includes a housing 324, a limb rest support plate 326, and a handle 328. Referring now to FIG. 13, the limb rest support plate 326 is supported on the housing 324 by a bearing 340. The clamp 320 also includes a threaded member 342 that passes through the limb rest support plate 326, bearing 340, and housing 324 and has threads 344 that engage threaded hole 346 in the handle 328. In addition, a bias member embodied as a group of Belleville washers 348 is positioned under a head 350 of the threaded member 342. When the handle 328 is turned in a left hand direction as indicated by arrow 352, the threaded member 342 moves in the direction of arrow 354, which reduces the load applied to the bias member 348 is reduced. By reducing the load and, thereby, the bias, a clamping action that is effected by the clamp 320 is reduced such that the limb rest support plate 326 is movable relative to the housing 324 to rotate the limb rest 332 about the axis 334 to change the orientation of the limb rest 332 relative to the spar 316. When the clamp 320 is tightened by reversing the direction of rotation of the handle 328, the action of the bias member 348 and the threaded member 342 increase the clamping force of the clamp 320 so that rotation of the limb rest support plate 326 relative to the housing 324 is precluded.

Referring now to FIG. 12, the collar 333 includes a housing 360 which is supported on two bearings 362, 364 which engage the spar 316. The bearings 362, 364 are retained within the housing by abutting respective flanges (not shown) formed in the housing and respective snap-rings 366, 368. Referring to FIG. 11, the housing 360 supports a spring-loaded handle 370 that pivots relative to the housing 360 on a pin (not shown) about an axis 372 and is urged in the direction of arrow 374 by a bias member 376 illustratively embodied as a helical spring. A block 378 is supported on an arm 380 of the spring-loaded handle 370 and is positioned to engage the channel 314 on the spar 316 when the handle 370 is in the position shown in FIGS. 10-11. When a grip 382 of the handle 370 is grasped by a user, the bias of bias member 376 may be overcome to move the block 378 out of channel 314. In this way, movement of the collar 333 about the spar 316 in the direction of arrow 384 is permitted.

The collar 333 further includes an elastomeric pad 386 supported in the housing 360. The pad 386 is deformable under a load to cause frictional interference between the collar 333 and the spar 316 to prevent movement of the collar 333 and, thereby, the coupler 330 along the spar 316. The weight of the limb rest 332 and, when a patient is present, the weight of a patient's limb, are supported in cantilever from the collar 333 creating a moment that is supported by the pad 386. The pad 386 deforms under the load causing friction between the pad 386 and a surface of the channel 312 which causes resistance against movement of the coupler 330 along the spar 316.

To move the collar 333 and, thereby, coupler 330 along the spar 316, a user squeezes the grip 382 of the handle 370 to disengage the block 378 from the channel 314. The user then manually lifts the limb rest 332 to unload the pad 386. Once the pad 386 is unloaded, the frictional resistance of movement along the spar 316 is removed and the coupler 330 is moveable to a new position on the spar 316. Once the coupler 330 is positioned appropriately, the user lowers the limb rest 332 to re-load the pad 386 and releases the grip 382 to cause the anti-rotation block 378 to re-engage channel 314.

Figure 14:
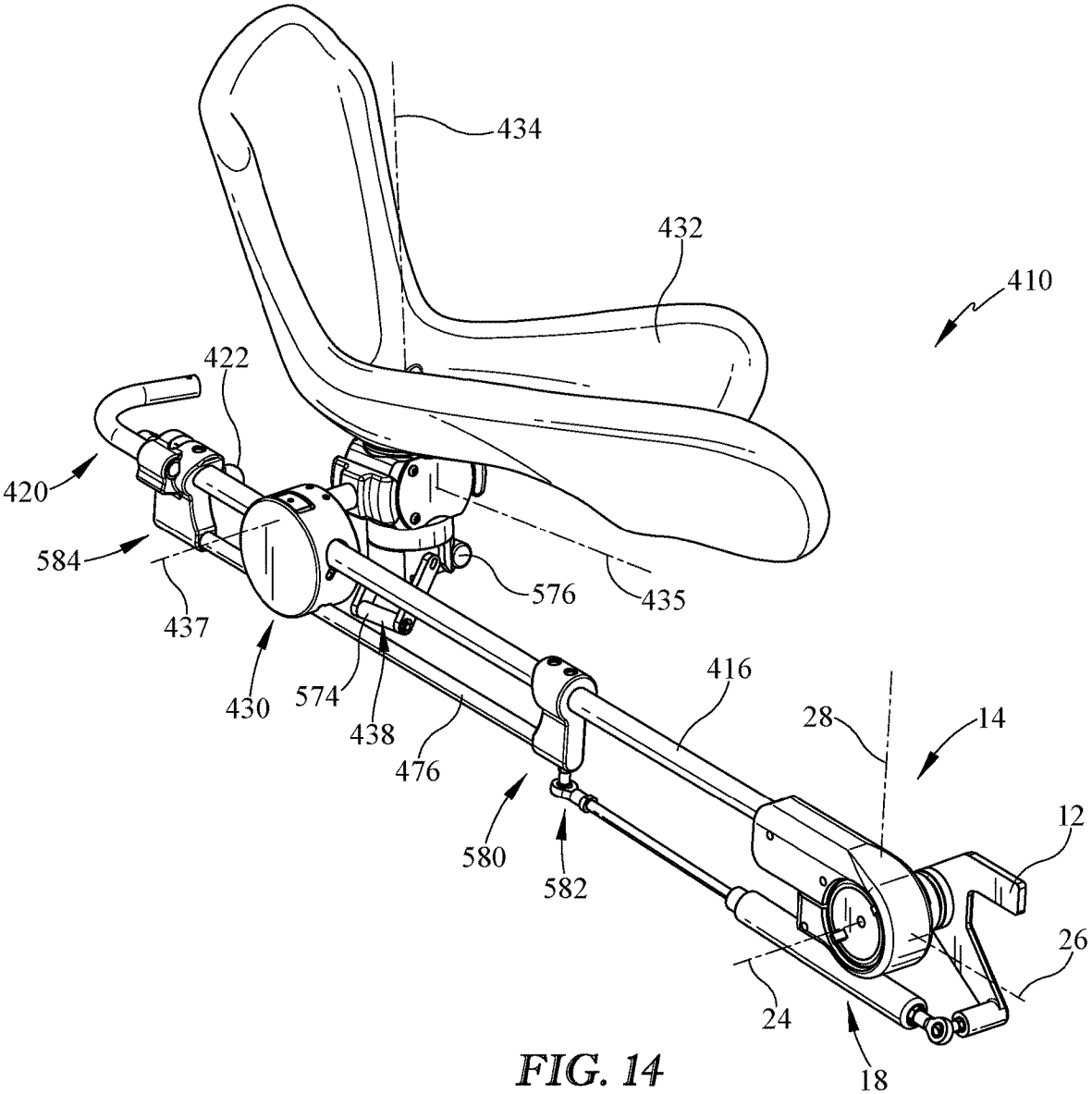
FIG. 14 is a perspective view of another embodiment of a limb support for use during surgery, the limb support configured to be mounted to a patient support apparatus.

Another embodiment of a limb support configured as a leg support 410 mountable to a patient support apparatus (not shown) and for positioning the leg of a patient in a number of different positions is shown in FIG. 14. The leg support 410 includes the mount 12 and coupler 14 for mounting the leg support 410 to a patient support apparatus similar to the operation of leg support 10 discussed above. The leg support 410 includes a spar 416 that is supported by the coupler 14. An adjustable coupler 430 supports a limb rest 432 from the spar 416 and is releasable to allow the position of the limb rest 432 to be adjusted along the length of the spar 416. The adjustable coupler 430 includes a handle 438 which may be actuated to cause the coupler 430 to be released to allow adjustment of the limb rest 432 about an axis 434 and an axis 435. When the handle 438 is actuated to a released position, the coupler 430 and limb rest 432 are free to move along the spar 416, and the limb rest 432 is adjustable about the axes 434 and 435. The handle 438 is biased to a locked position (shown in FIGS. 14 and 15) wherein the movement along the spar 416 and about axes 434 and 435 is precluded. As will be discussed in further detail below, the limb rest 432 is always free to rotate about an axis 437 through a limited range of motion. This allows the limb rest 432 to self-adjust to an appropriate position when the spar 416 is moved about the axes 24, 26, and 28 to adjust the positon of the patient's limb relative to the patient support apparatus that the mount 12 engages.

The spar 416 is supported relative to the mount 12 by a counterbalancing gas spring 418 which assists in supporting the weight of a patient's leg when the leg support 410 is in use or the position is being adjusted. A handle 420 positioned on a distal end of the spar 416 relative to the mount 12 is configured to be used by a user to position the spar 416 and includes a release trigger 422 that, when gripped by a user, causes the lockable multi-axis coupler 14 to be released to allow the spar 416 to move relative to the mount 12. Movement of the spar 416 relative to the mount 12 is facilitated in the pitch axis 24, roll axis 26, and yaw axis 28 as suggested in FIG. 14. In the illustrative embodiment, this permits abduction, adduction, and lithotomy adjustments of the patient's leg. In should be understood that the movement could be equally applicable to a patient's arm.

The illustrative leg support 410 is configured to support a patient's left leg. In many cases, a second leg support that is a mirror duplicate of the leg support 410 will be used to support the right leg of a patient. The present disclosure includes an adjustable coupler 430 that permits of adjustment of the relative position and orientation of a limb rest 432 relative to the spar 416.

Figure 15:
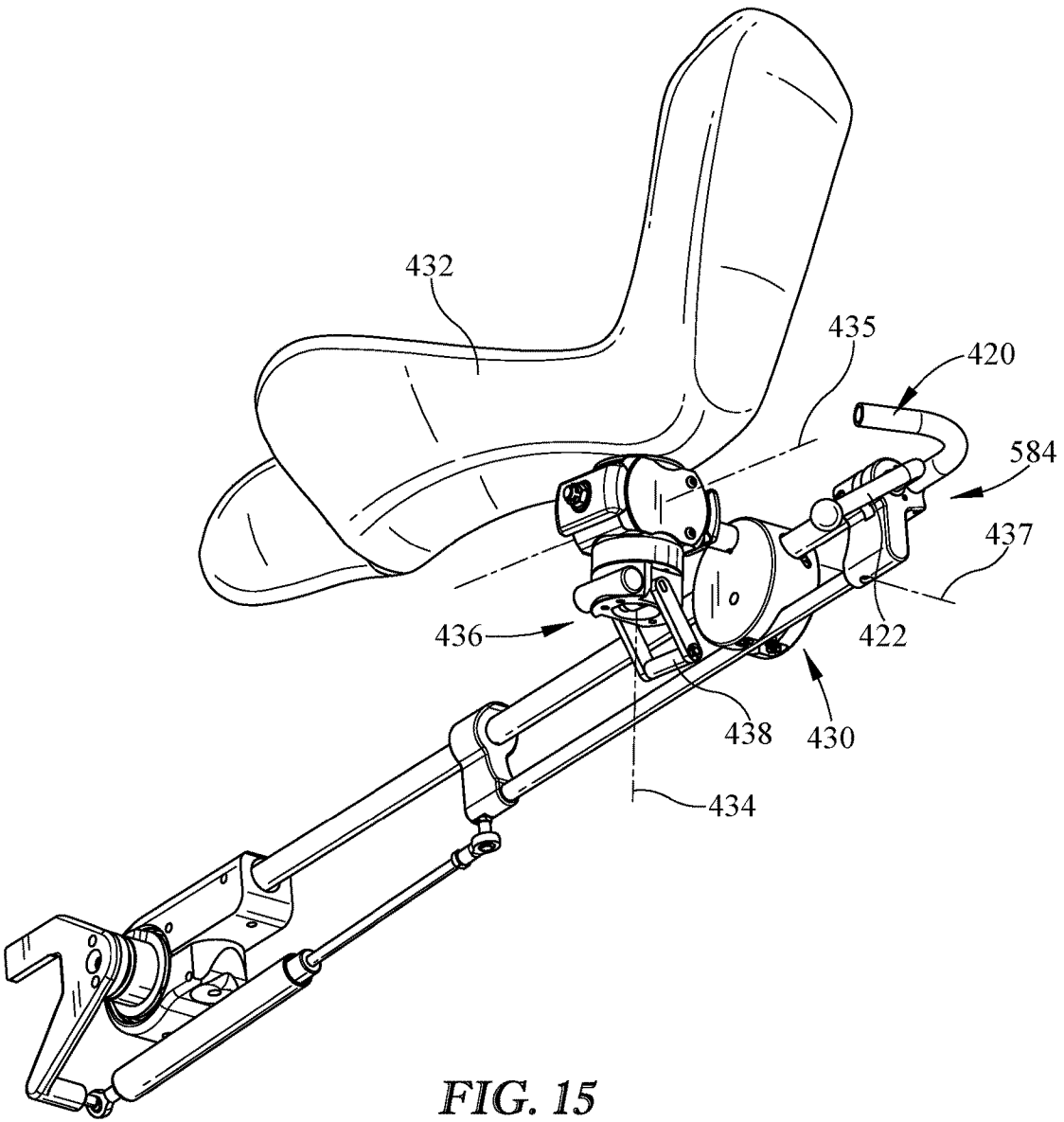
FIG. 15 is another view of the limb support of FIG. 14 viewed from a different perspective.

Referring to FIG. 15, the adjustable coupler 430 includes a release 436 that includes the handle 438 that may be pulled in the direction of arrow 440 to move the release 436 in the direction of arrow 440 shown in FIG. 15. As will be described in further detail below, the movement of handle 438 in the direction of arrow 40 is transferred by a cam action to a plunger 42 to move the plunger 42 between a first position shown in FIG. 17 and a second position shown in FIG. 18. The handle 438 is pivotable relative to a base member 442 with two lever arms 570, 572 coupled to a grip 574 providing a mechanical advantage to overcome a spring bias to release three degrees of freedom for the coupler 430 relative to the spar 416. A second grip 576 is mounted on the side of the base member 442 so that a user may positon their palm on the grip 576 and grasp the grip 576 with their fingers to provide leverage for moving the handle 438 to a released position. In some cases, the user may grip a foot portion 578 of the limb rest 432 with their other hand to position the limb rest 432 when the release 426 is moved to the released position.

Figure 19:
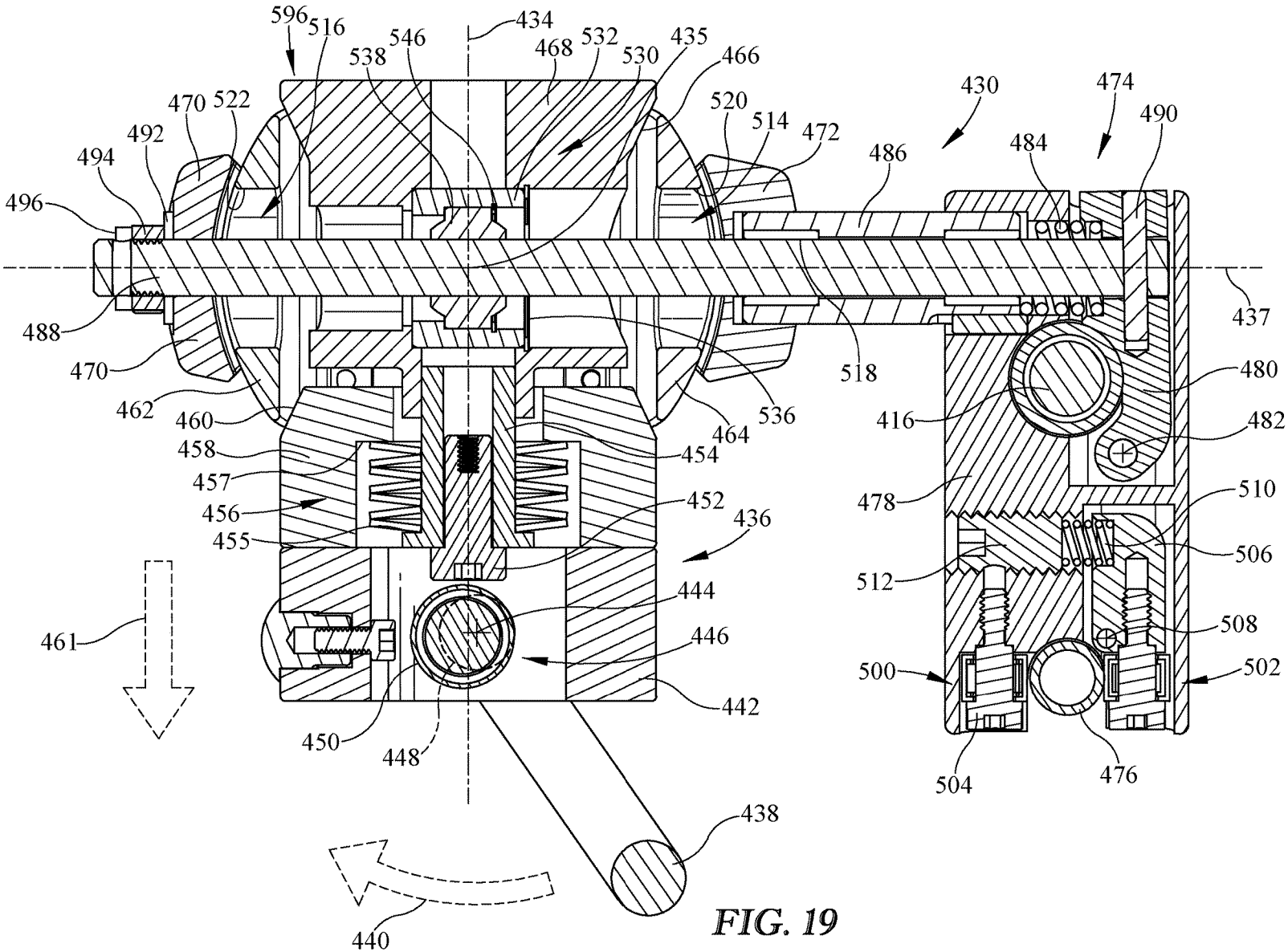
FIG. 19 is a cross-sectional plan view of a portion of the coupler of FIG. 16 and the spar when the release is in the first, non-released position of FIG. 17.

A general understanding of the operation of the coupler 430 may be best understood by reference to FIG. 19 which is a cross-sectional view of the coupler 430. The handle 438 is shown in a neutral position but is movable relative to a base 442 about an axis 444 in the direction of arrow 440. A cam 446 is driven by the handle 438 such that a shaft 448 rotates and drives a cam lobe 450 into contact with a member 452. The member 452 engages a dependent shaft 454 such that the shaft 454 secures a bias assembly 456 which is illustratively embodied as a stack of Belleville washers 453 between a flange 455 of the shaft 454 and a flange 457 of a floating lock ring 458. The shaft 454 is secured to a fixed lock ring 468 by a press fit. In some embodiments, the shaft 454 may be threaded into the fixed lock ring 468 or secured relative to the fixed lock ring 468 by other means. The movement of the handle 438 effectively causes a floating lock ring 458 to be urged downwardly in the direction of an arrow 461. When the floating lock ring 458 is in the position shown in FIG. 19, an annular cam surface 460 acts on a pair of wedge plates 462, 464 urging the wedge plates 462, 464 to engage with an annular surface 466 of the fixed lock ring 468. The fixed lock ring 468 includes an upper plate 596 that functions as a limb rest mounting plate with the limb rest 432 being mountable to the upper plate 596 to move therewith.

Figure 16:
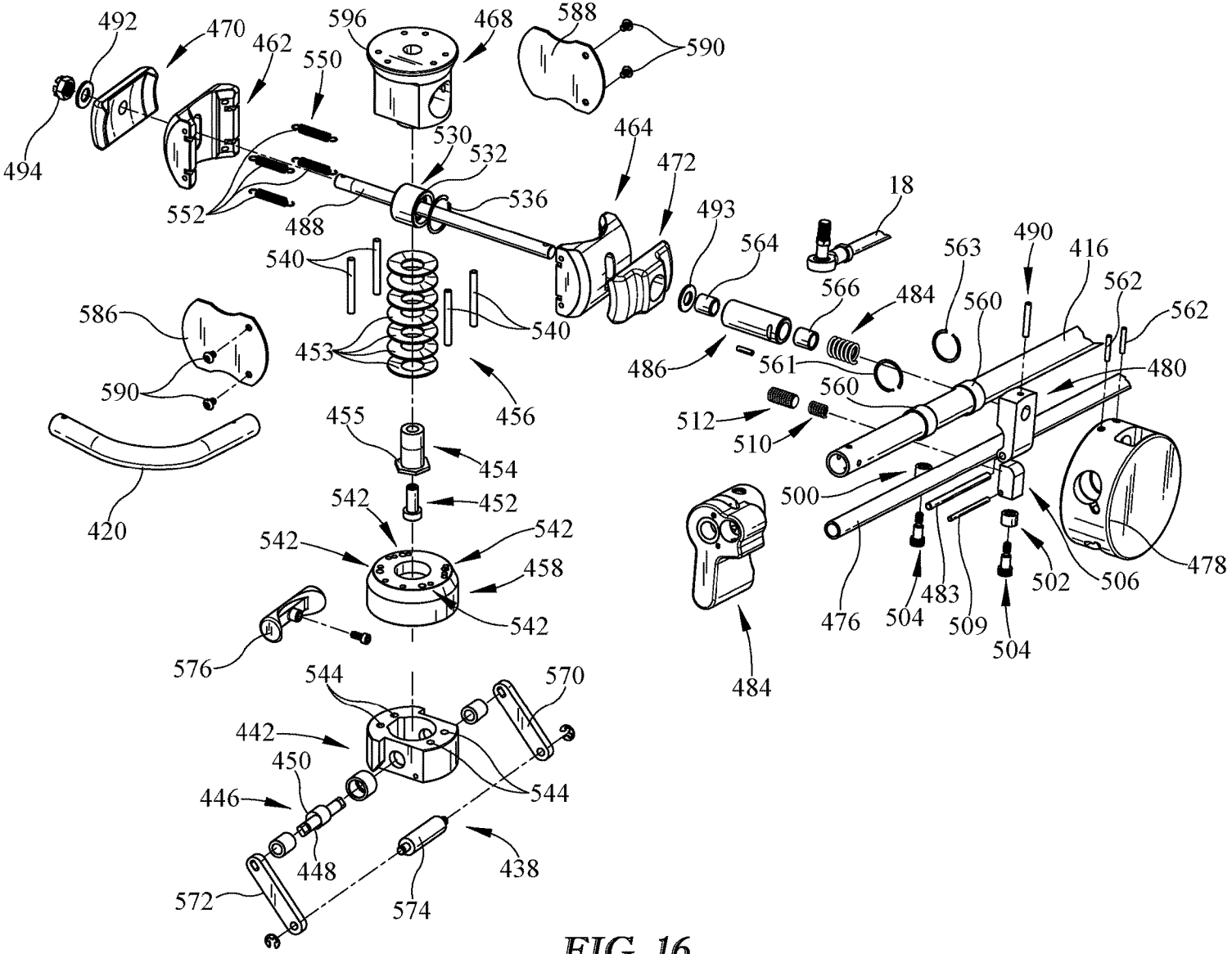
FIG. 16 is an exploded view of a coupler of the limb support of FIG. 14, the coupler operable to support and adjust a limb rest relative to a spar of the limb support.

Referring now to FIG. 16, the base 442 is secured to the floating lock ring 458 by a number of press fit pins 540 that are pressed into holes 542 of the floating lock ring 458 and into holes 544 of the base 442. The wedge plates 462 and 464 are also coupled together by a bias assembly 550, which is embodied as four helical springs 552 in the disclosed embodiment.

Figure 17:
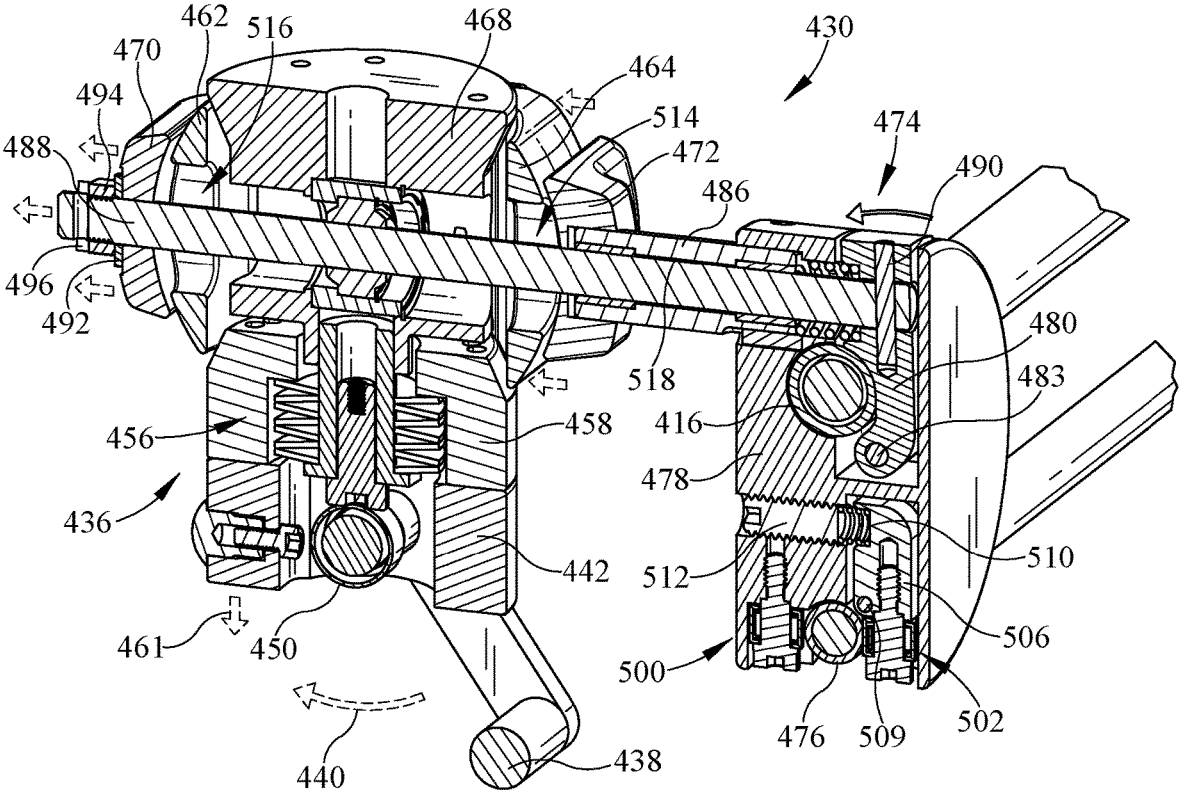
FIG. 17 is a cross-sectional perspective view of a portion of the coupler of FIG. 16 with a selectively actuable release in a first, non-released position.
Figure 18:
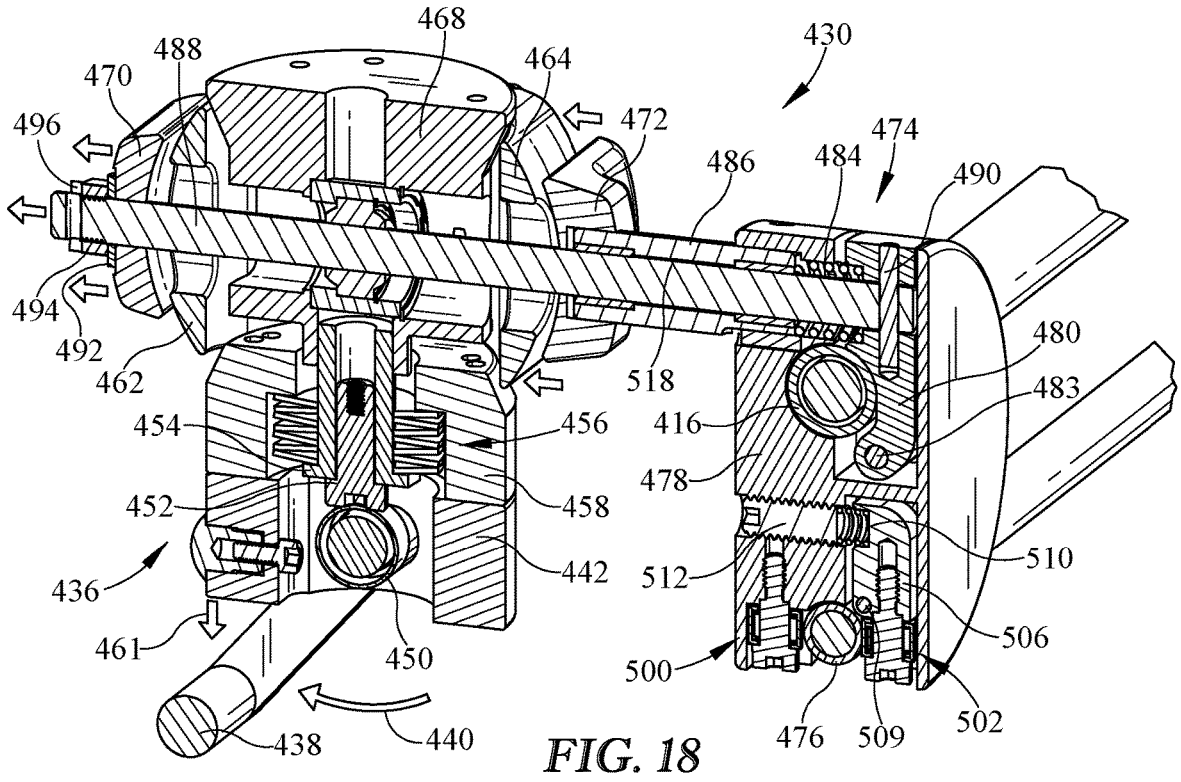
FIG. 18 is a perspective cross-section perspective view similar to FIG. 17 with the release in a second, released position.

Referring to FIGS. 17-18, as the wedge plates for 462, 464 engage the annular surfaces 460, 466, the wedge plates 462, 464 are also urged outwardly away from the axis 434 and into engagement with a pair of fixed plates 470, 472, respectively. Once the wedge plates 462, 464 are fully engaged with the fixed plates 470, 472, the load of the bias assembly 456 is sufficient to resist movement of the fixed lock ring about the axis 434 and the axis 435. As suggested in FIG. 16, a pair of covers 586, 588 are each secured to the wedge plate 464 by a pair of fasteners 590. Thus, the release 436, when it is in the locked position of FIG. 19, prevents movement of the limb rest 432 relative to two degrees of freedom, namely, axes 434, 435. When the release 436 is moved to the released position shown in FIG. 19, the limb rest mounting plate 596 and the limb rest 432 are free to move in two degrees of freedom about the axes 434, 435.

Figure 20:
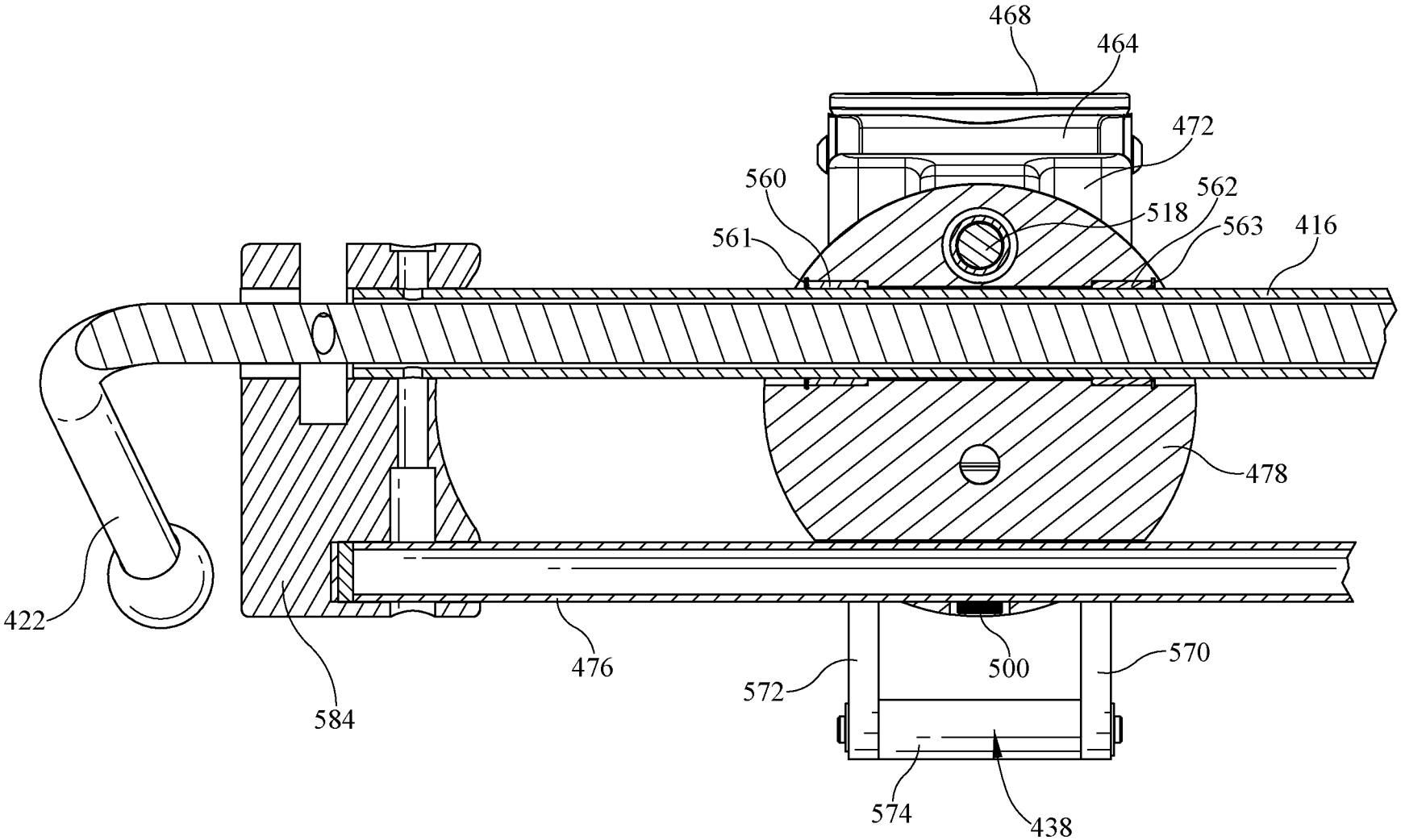
FIG. 20 is a cross-sectional plan view of the coupler supported on the spar and a guide rod.
Figure 21:
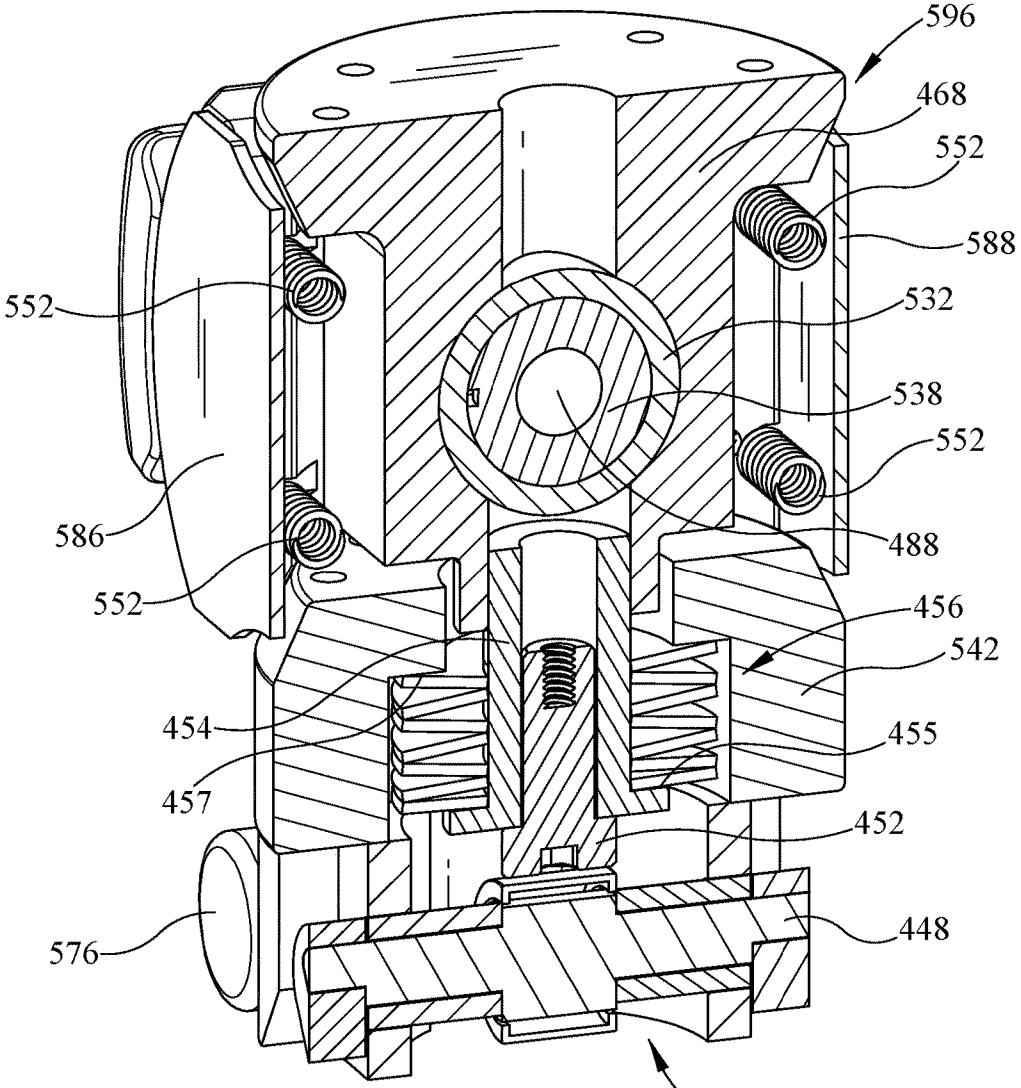
FIG. 21 is a cross-sectional view of a portion of the coupler of FIG. 16 taken along a cross-sectional plane that is orthogonal to the cross-sectional plane of FIG. 19.

The release 436 also affects a third degree of freedom in that the release controls the locking of the coupler 430 to the spar 416. A carriage 474 of the coupler 430 is supported on the spar 416 then moves relative to the spar 416 and a guide rod 476 to vary the distance between the limb rest 432 and the mount 12 which results in the variation of the distance of the limb support relative to a patient support apparatus to which the leg support 410 is mounted in use. The guide rod 476 and spar 416 are each coupled to a fixed coupler 580 positioned at one end of the guide rod 476. The fixed coupler 580 is also engaged by a rod end 582 of the gas spring 18. The spar 416 and guide rod 476 are coupled at an end of the guide rod 476 opposite the fixed coupler 580 by a mount 584. The mount 584 secures the handle 420, the guide rod 476, and the spar 416. The release trigger 422 extends through the spar 416 as shown in FIG. 20.

Referring to FIGS. 17-20, the carriage 474 includes a frame 478 and a lock 480 which is pivotably supported on the frame 478 and pivotable about an axis 482 which is defined by a pin 483. A bias member 484 engages the lock 480 and a tube shaft 486 which is secured to the frame 478 by a pair of pins 562, 562 (best seen in FIG. 16) and engages with the fixed plate 472. When the release 436 is in the position shown in FIG. 19, the floating lock ring 458 urges the wedge plates 462, 464 outwardly away from the axis 434 to engage with the fixed plates 470, 472. Force is transferred through wedge plates 462, 464 to the fixed plates 470, 472, urging them outwardly away from the axes 434, 435.

A shaft 488 extends through the fixed lock ring 468, the fixed plates 470, 472, the wedge plates 462, 464, the tubular shaft 486, engaging a pair of bearings 564, 566 positioned in the tubular shaft 486 and shaft 488 and is secured to the lock 480 by a pin 490. The shaft 488 is secured on the opposite end by a thrust bearing 492 and a lock nut 494 which is adjusted to provide a preload on the lock 480 that is sufficient to secure the carriage 474 to the spar 416 when the release 436 is in the position shown in FIG. 19. The lock nut 494 is secured by a pin 496. In other words, the action of the wedges 462, 464 on the fixed plates 470, 472 induces a load in the shaft 488 which is applied to the lock 480. The load in the shaft 488 is transferred to the thrust bearing 492 and a thrust bearing 493 that is positioned between the tubular shaft 486 and the fixed plate 472. The thrust bearings 492, 493 permit rotation of a portion of the coupler 430 relative to the tubular shaft 486, shaft 488, and carriage 474 about the axis 437 at all times. When the release 436 is in a locked position, such as that shown in FIGS. 17 and 19, the load of the shaft 488 tends to resist rotation of that portion of coupler 430 about axis 437, but an operator may use manual force to cause the rotation to adjust the pitch of the limb rest 432 relative to the spar 416. In this way, the limb rest 432 is adjustable relative to the spar 416 in at least one degree of freedom at all times.

The bias member 484, illustratively embodied as a helical spring, resists the load induced in the shaft 488. However, in normal operating conditions the load induced in the shaft 488 is a multiple of the load of the bias member 484 such that the bias member 484 is overcome by the load of the shaft 488 and compresses. When the handle 438 is moved to a released position, such as that shown in FIG. 18, then the shaft 488 is unloaded and the bias member 484 urges the lock 480 out of engagement with the spar 416 so that the carriage 474 is free to move along the spar 416. Movement of the carriage 474 along the spar 416 is eased by the engagement of two bearings 560, 560, that support the frame 478 on the spar 416. The bearings 560 and 560 are retained relative to the frame 478 by respective snap rings 561, 563 as shown in FIGS. 16 and 20.

The frame 478 of carriage 474 does not directly engage the guide tube 476, but the carriage 474 engages with the guide tube 476 through a pair of needle bearings 500, 502. The needle bearing 500 is secured to the frame 478 by a fastener 504 such that the needle bearing 500 is fixed relative to the frame 478. The needle bearing 500 to is secured to a floating arm 506 which is pivotably connected to the frame 478 and pivotable about an axis 508. A bias member 510, illustratively embodied as a helical spring, engages the floating arm 506 urging the floating arm 506 to pivot about the axis 508 to engage the needle bearing 502 with the guide shaft 476. A load is induced in the bias member 510 by a set screw 512 which is threaded into the frame 478 to create a preload in the bias member 510 sufficient to keep the needle bearing 500 to engaged with the guide shaft 476. This arrangement eliminates the need for close tolerance machining and establishes an appropriate load in the needle bearings 500, 502. The engagement of the needle bearings 500, 502 with the guide tube 476 resists the rotation of the coupler 430 about the spar 416 when a load is placed on the limb rest 432.

Unlike the embodiment of limb support 10, leg support 410 is not adjustable about the spar 416, but role about the axis 435 is facilitated by clearance in the wedge plates 462, 464 which each have a respective slot 514, 516 which permit a limited amount of role about the axis 435 when the release 436 is moved to the released position, such as that shown in FIG. 18. The range of motion in the roll direction is defined by the clearance between an outer surface 518 of shaft 488 and an outboard edge 520, 522 of the respective slots 514, 516. Thus, the fixed lock ring 468 is permitted to rotate through an angle about axis 435. That is limited by the slots 514, 516. In the illustrative embodiment, the angle of permitted rotation is about 12 degrees.

The coupler 430 includes a bearing structure 530 that is positioned in the fixed lock ring 468. The bearing structure 530 includes an outer bearing housing 532 that is positioned through an aperture 534 in the fixed lock ring 468 best seen in FIG. 16. Referring to FIG. 19, a spherical bearing 538 is positioned in the outer bearing housing 532 and fully engages the shaft 488. The spherical bearing 538 is secured to the outer bearing housing by a snap ring 546 and the outer bearing housing 532 is secured into the fixed lock ring 468 by a snap ring 536. As the fixed lock ring 468 is pivoted about the axis 435, the spherical bearing 538 permits some freedom of movement relative to the shaft 488.

Although certain illustrative embodiments have been described in detail above, variations and modifications exist within the scope and spirit of this disclosure as described and as defined in the following claims.

The invention claimed is:

1. A limb support comprising a spar configured to be supported from a patient support apparatus and adjustable relative to the patient support, the spar having a longitudinal axis, a limb rest configured to support the limb of a patient supported on the patient support apparatus, and a coupler interposed between the limb rest and the spar, the coupler including a single release that is manually selectively actuable to (i) release the limb rest to rotate about a first axis that is offset from the longitudinal axis of the spar to a plurality of orientations relative to the spar, and (ii) release the coupler relative to the spar to allow the coupler to move along the longitudinal axis of the spar, wherein at least a portion of the coupler engages the spar such that rotation of the coupler about the longitudinal axis of the spar is precluded by the engagement of the portion of the coupler with the spar regardless of the position of the release.

2. The limb support of claim 1, wherein the portion of the coupler that precludes rotation of the limb support about the longitudinal axis of the spar comprises a clamp with a rotation lock.

3. The limb support of claim 2, wherein the coupler further comprises a collar that supports the clamp.

4. The limb support of claim 3, wherein the rotation lock prevents movement of the clamp relative to the collar.

5. The limb support of claim 4, wherein the rotation lock is releasable to permit rotation of the clamp relative to the collar.

6. The limb support of claim 3, wherein the rotation lock is adjustable to allow the clamp to be adjusted to a plurality of positions relative to the collar.

7. The limb support of claim 3, wherein the spar and the collar include a plurality of interengageable anti-rotation elements that cooperate to prevent continuous rotation of the collar about the longitudinal axis of the spar.

8. The limb support of claim 1, wherein a release mechanism of the coupler is acted upon by the release to permit rotation of the limb rest about a first axis includes an actuator that moves along the first axis when the release is actuated.

9. The limb support of claim 8, wherein the release mechanism includes a locking plate that is disengaged by the actuator and guides to maintain an orientation of the locking plate such that the locking plate is precluded from rotating about the first axis regardless of the position of the release.

10. The limb support of claim 9, wherein the locking plate includes anti-rotation features that engage to prevent rotation of the limb rest when the release is not actuated.

11. The limb support of claim 10, wherein the anti-rotation features are disengaged to thereby allow rotation of the limb rest when the release is actuated.

12. The limb support of claim 1, wherein actuation of the release causes movement of a first plunger along the first axis which causes movement of a linkage that transfers the motion from the first plunger to a second plunger along a second axis perpendicular to the first axis to cause movement of a release member in a direction parallel' to the movement of the second plunger, allowing the limb support to move along the spar.

13. A coupler for a limb support apparatus comprising a limb rest support configured to engage a limb rest, a collar configured to engage an adjustable support arm extending from a patient support apparatus, and a single release that is manually selectively actuable to (i) release the limb rest support to rotate about a first axis that is offset from the longitudinal axis of the support arm to a plurality of orientations relative to the support arm, and (ii) release the coupler relative to the support arm to allow the coupler to move along the longitudinal axis of support arm, wherein at least a portion of the coupler is configured to engage the support arm such that rotation of the coupler about the longitudinal axis of the support arm is precluded by the engagement of the portion of the coupler with the support arm regardless of the position of the release.

14. The coupler of claim 13, wherein the portion of the coupler that precludes rotation of the coupler about the longitudinal axis of the support arm comprises a clamp with a rotation lock.

15. The coupler of claim 14, wherein the clamp is supported by the collar.

16. The coupler of claim 15, wherein the rotation lock prevents movement of the clamp relative to the collar.

17. The coupler of claim 13, wherein the collar includes a plurality of anti-rotation elements that are configured to engage mating elements of the support arm cooperate to prevent continuous rotation of the collar about the longitudinal axis of the support arm.

18. The coupler of claim 13, wherein a release mechanism of the coupler is acted upon by the release to permit rotation of the limb rest support about a first axis includes an actuator that moves along the first axis when the release is actuated.

19. The coupler of claim 18, wherein the release mechanism includes a locking plate that is disengaged by the actuator and guides to maintain an orientation of the locking plate such that the locking plate is precluded from rotating about the first axis regardless of the position of the release.

20. The coupler of claim 19, wherein the locking plate includes anti-rotation features that engage to prevent rotation of the limb rest when the release is not actuated.

21. The coupler of claim 20, wherein the anti-rotation features are disengaged to thereby allow rotation of the limb rest when the release is actuated.

22. The coupler of claim 13, wherein actuation of the release causes movement of a first plunger along the first axis which causes movement of a linkage that transfers the motion from the first plunger to a second plunger along a second axis perpendicular to the first axis to cause movement of a release member in a direction parallel' to the movement of the second plunger, allowing the limb rest support to move along the adjustable support arm.

* * * * *